US010405726B2

(12) United States Patent
Kim

(10) Patent No.: US 10,405,726 B2
(45) Date of Patent: Sep. 10, 2019

(54) DISHWASHER WITH A MAIN ARM AND AN AUXILIARY ARM

(71) Applicant: LG ELECTRONICS INC., Seoul (KR)

(72) Inventor: Minchul Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 155 days.

(21) Appl. No.: 15/398,777

(22) Filed: Jan. 5, 2017

(65) Prior Publication Data

US 2017/0188780 A1 Jul. 6, 2017

(30) Foreign Application Priority Data

Jan. 5, 2016 (KR) ..... 10-2016-0000979

(51) Int. Cl.
*A47L 15/20* (2006.01)
*A47L 15/23* (2006.01)
*A47L 15/42* (2006.01)

(52) U.S. Cl.
CPC ..... *A47L 15/23* (2013.01); *A47L 15/20* (2013.01); *A47L 15/421* (2013.01); *A47L 15/4217* (2013.01)

(58) Field of Classification Search
CPC ..... A47L 15/18–23
See application file for complete search history.

(56) References Cited

U.S. PATENT DOCUMENTS

| | | |
|---|---|---|
| 2011/0146734 A1 | 6/2011 | Rappette |
| 2015/0182095 A1 | 7/2015 | Lee et al. |

FOREIGN PATENT DOCUMENTS

| | | |
|---|---|---|
| CN | 103371789 | 10/2013 |
| CN | 106361240 | 2/2017 |
| DE | 4407267 | 9/1994 |
| EP | 3120746 | 1/2017 |
| JP | H-04164427 | 6/1992 |
| JP | H-07336 | 1/1995 |
| JP | 2015009011 | 1/2015 |
| KR | 10-2012-0134370 | 12/2012 |

(Continued)

OTHER PUBLICATIONS

International Search Report in International Application No. PCT/KR2017/000023, dated Apr. 21, 2017, 9 pages (with English translation).

(Continued)

*Primary Examiner* — Spencer E Bell
(74) *Attorney, Agent, or Firm* — Fish & Richardson P.C.

(57) ABSTRACT

A dishwasher is disclosed. The dishwasher includes a tub, a main arm and an auxiliary arm for spraying water to an object to be washed, a fixed gear unit for rotatably supporting the main arm, a rotating gear unit configured to be rotated in engagement with the fixed gear part, a link unit for allowing the auxiliary arm to perform a reciprocating rolling movement, and an auxiliary arm connection unit. The auxiliary arm connection unit includes an extension pipe, a shaft extending from the extension pipe in order to support an interior of the auxiliary arm, and a sealing member protruding from an outer circumferential surface of the extension pipe. The sealing member includes a support member provided on at least one of an upper portion of the sealing member and a lower portion of the sealing member in order to support the interior of the auxiliary arm.

20 Claims, 19 Drawing Sheets

(a)

(56) References Cited

FOREIGN PATENT DOCUMENTS

KR 10-2013-0110867 10/2013

OTHER PUBLICATIONS

Extended European Search Report in European Application No. 17150250.3, dated Mar. 28, 2017, 9 pages (with English translation).
Office Action in Chinese Application No. 201710006823.9, dated Sep. 30, 2018, 18 pages (with English Translation).

【figure 1】
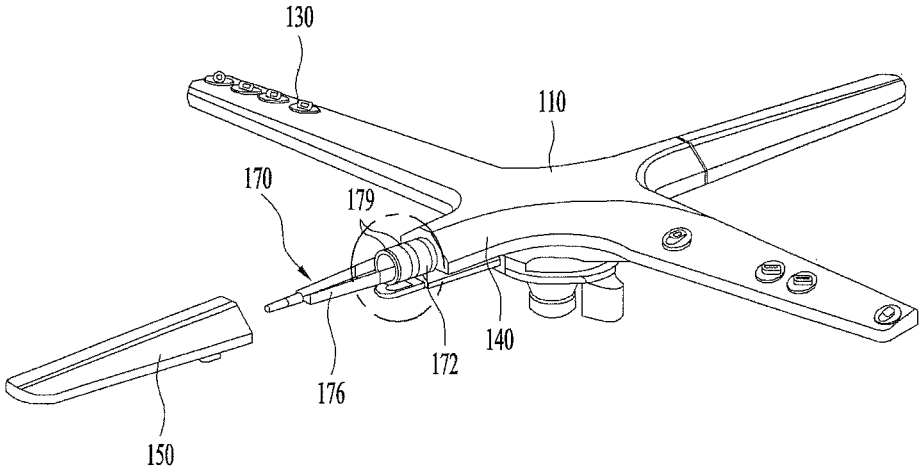
(a)
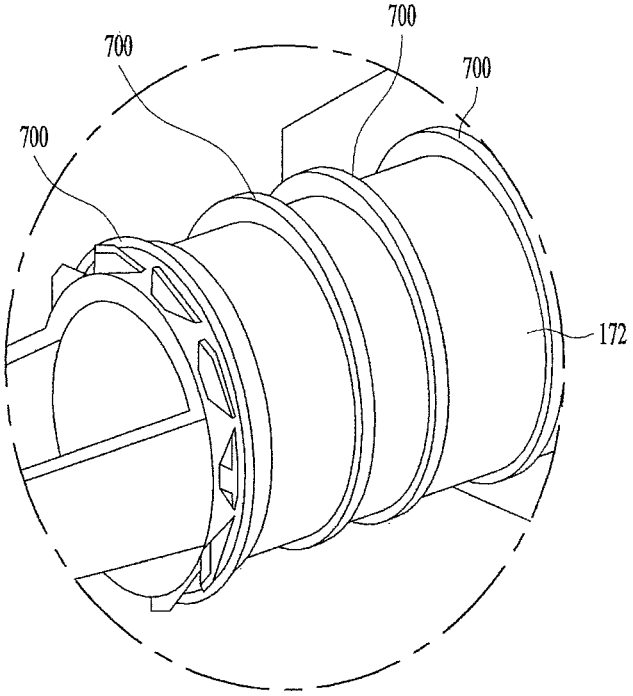

【figure 2】
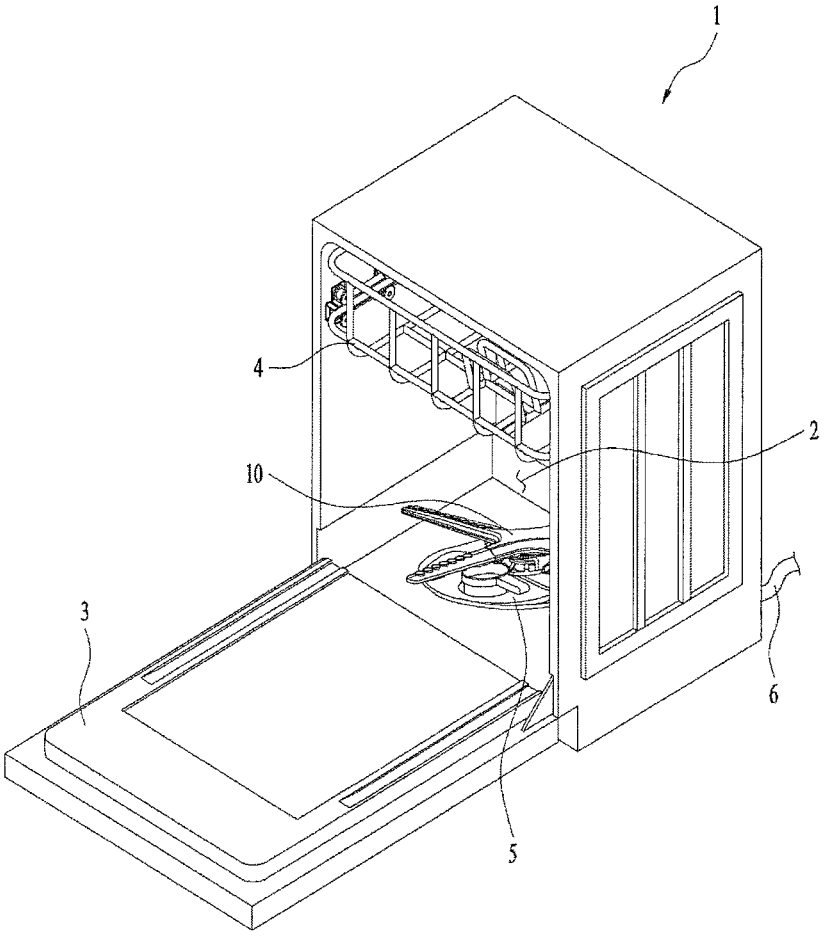

【figure 3】
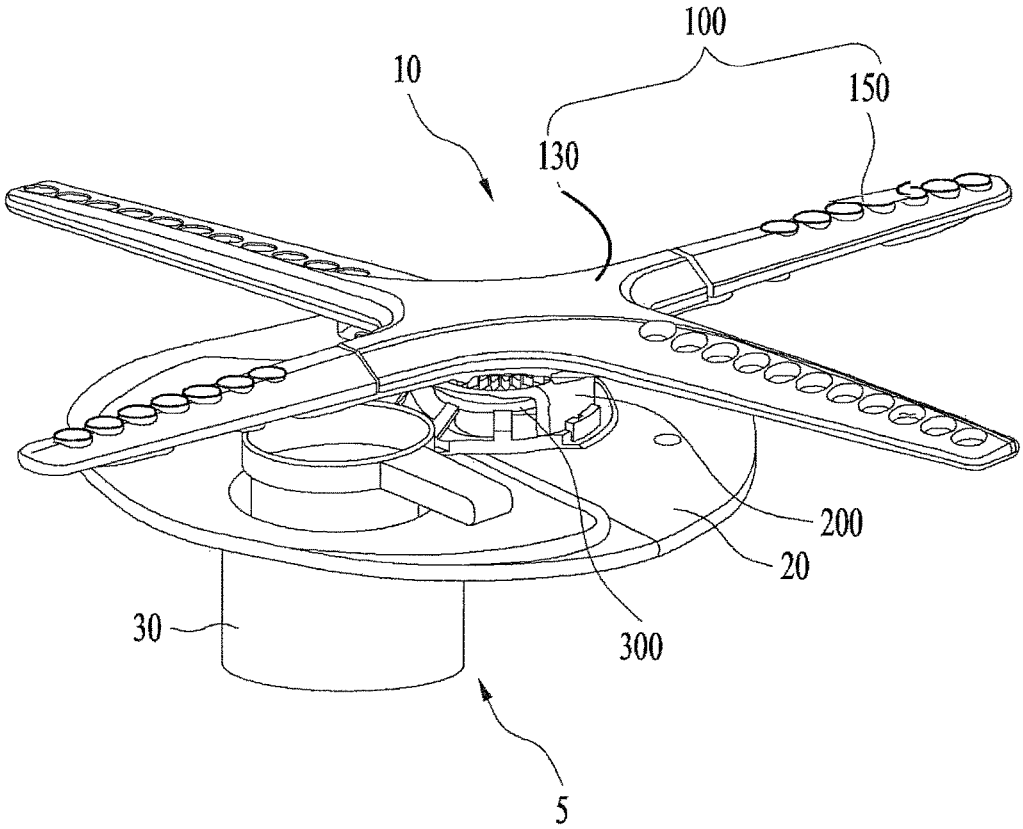

【figure 4】
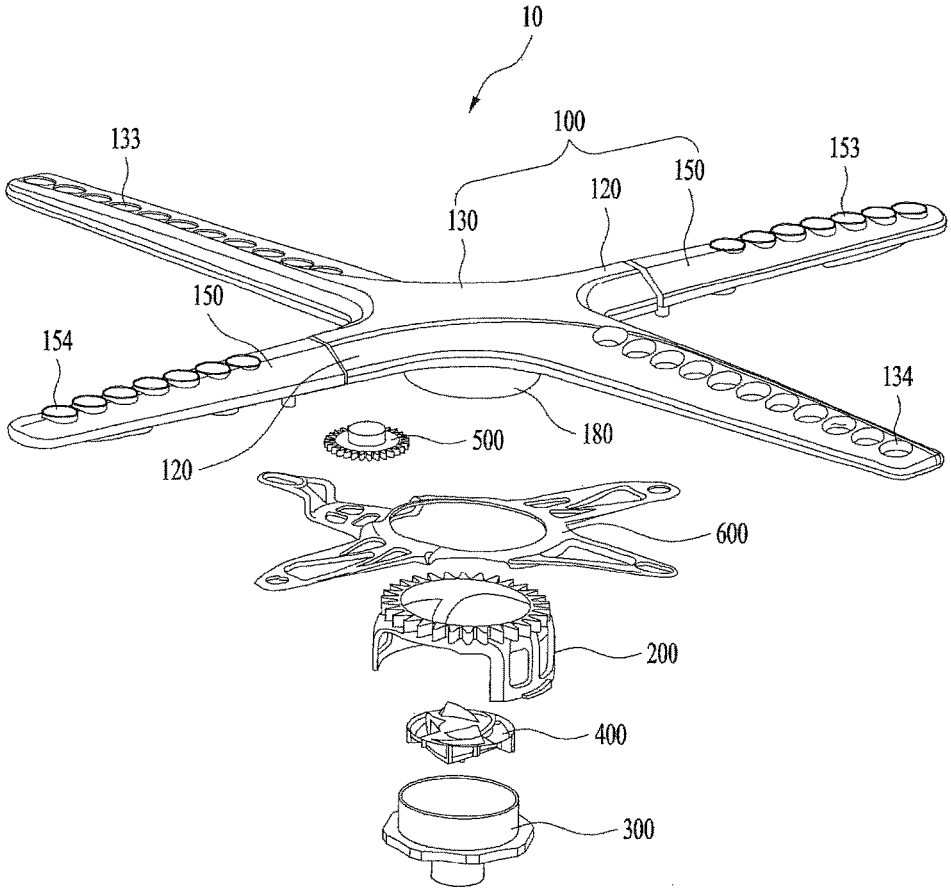

【figure 5】
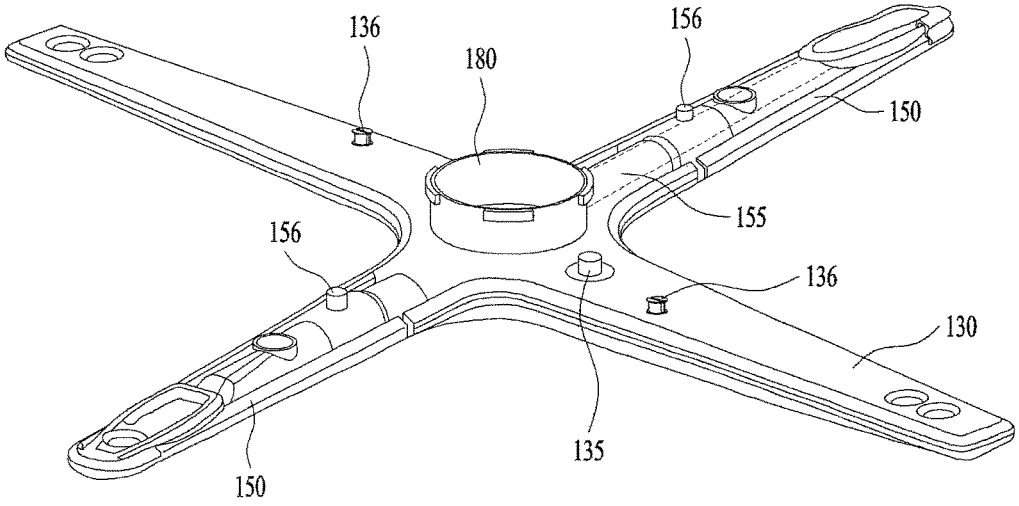

【figure 6】
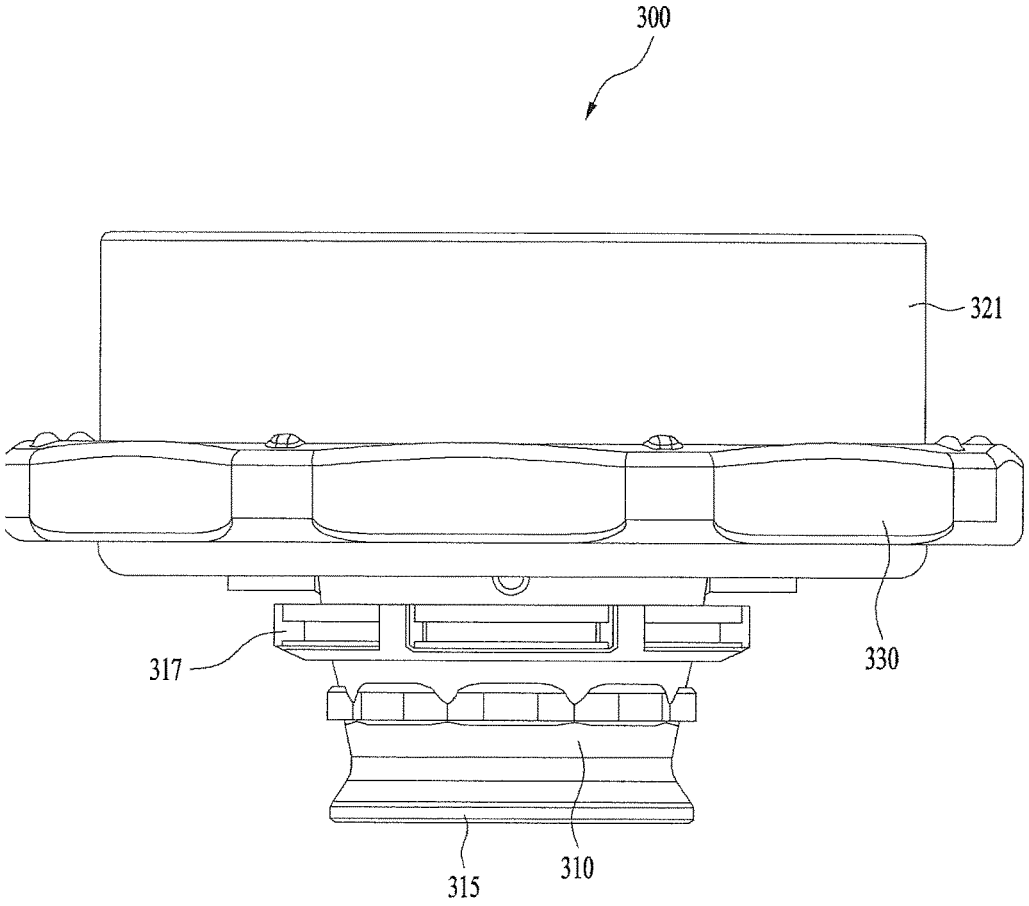

【figure 7】
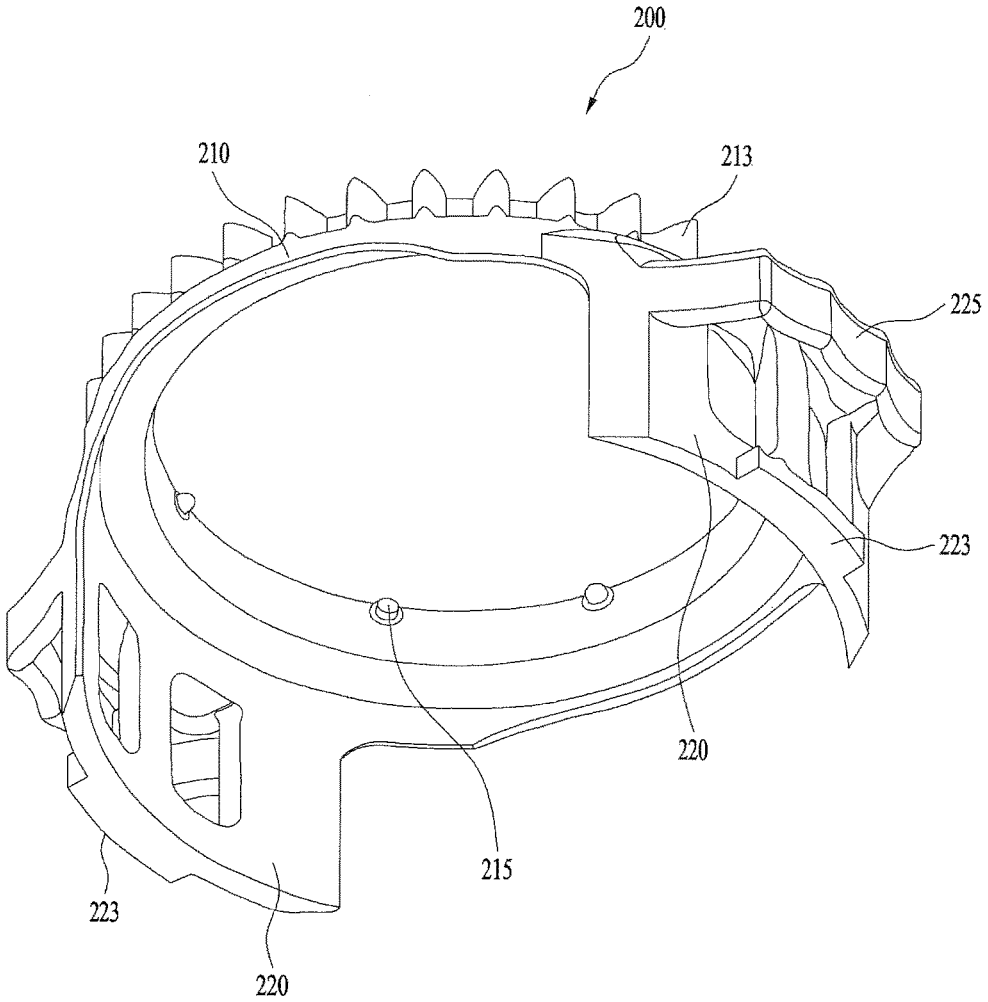

【figure 8】
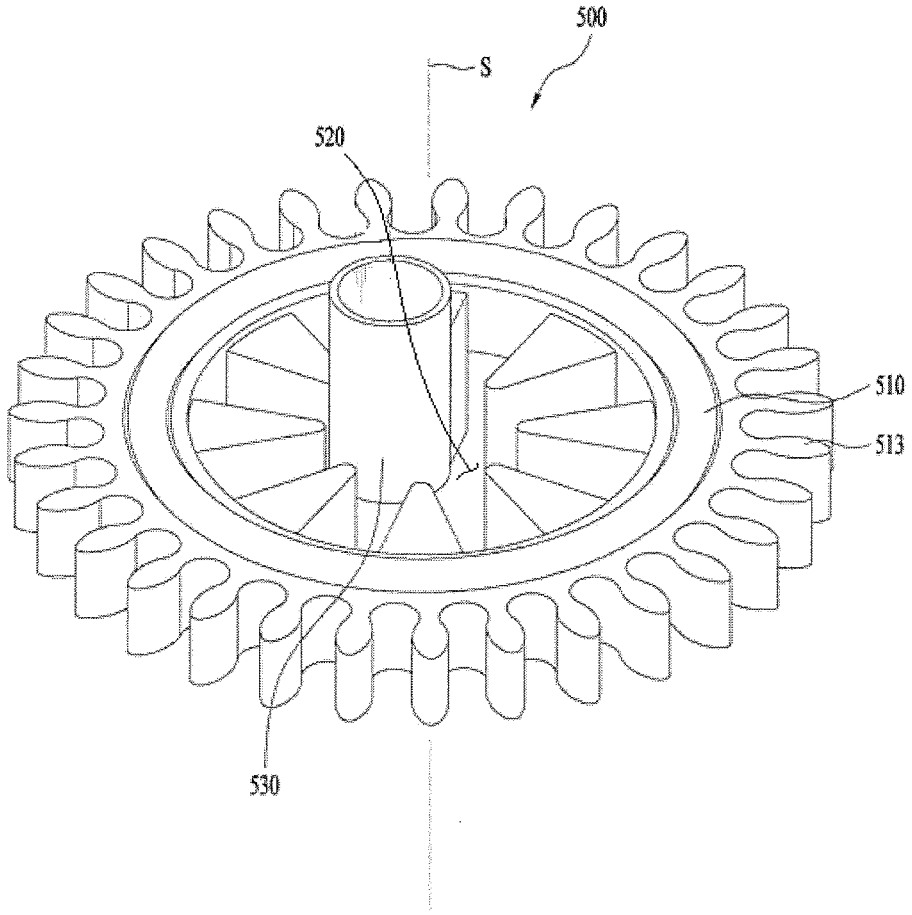

【figure 9】
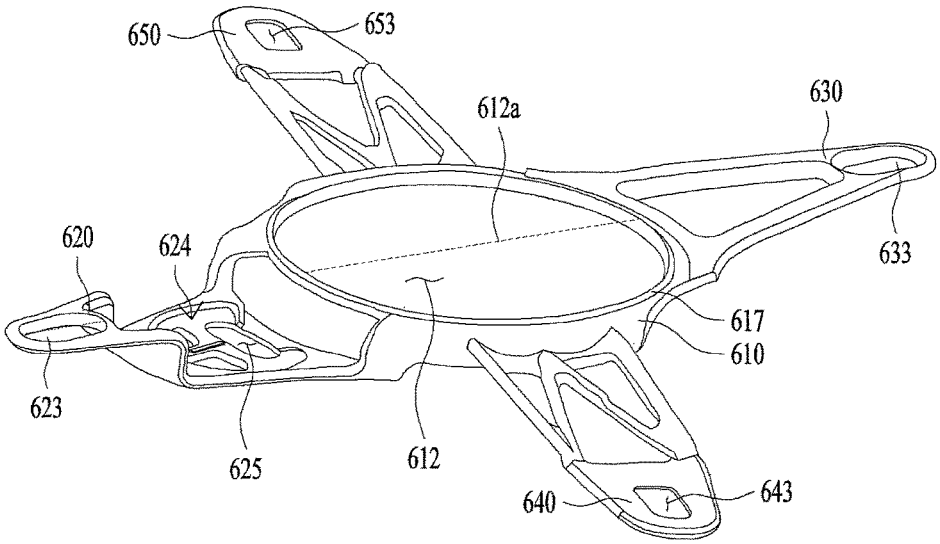

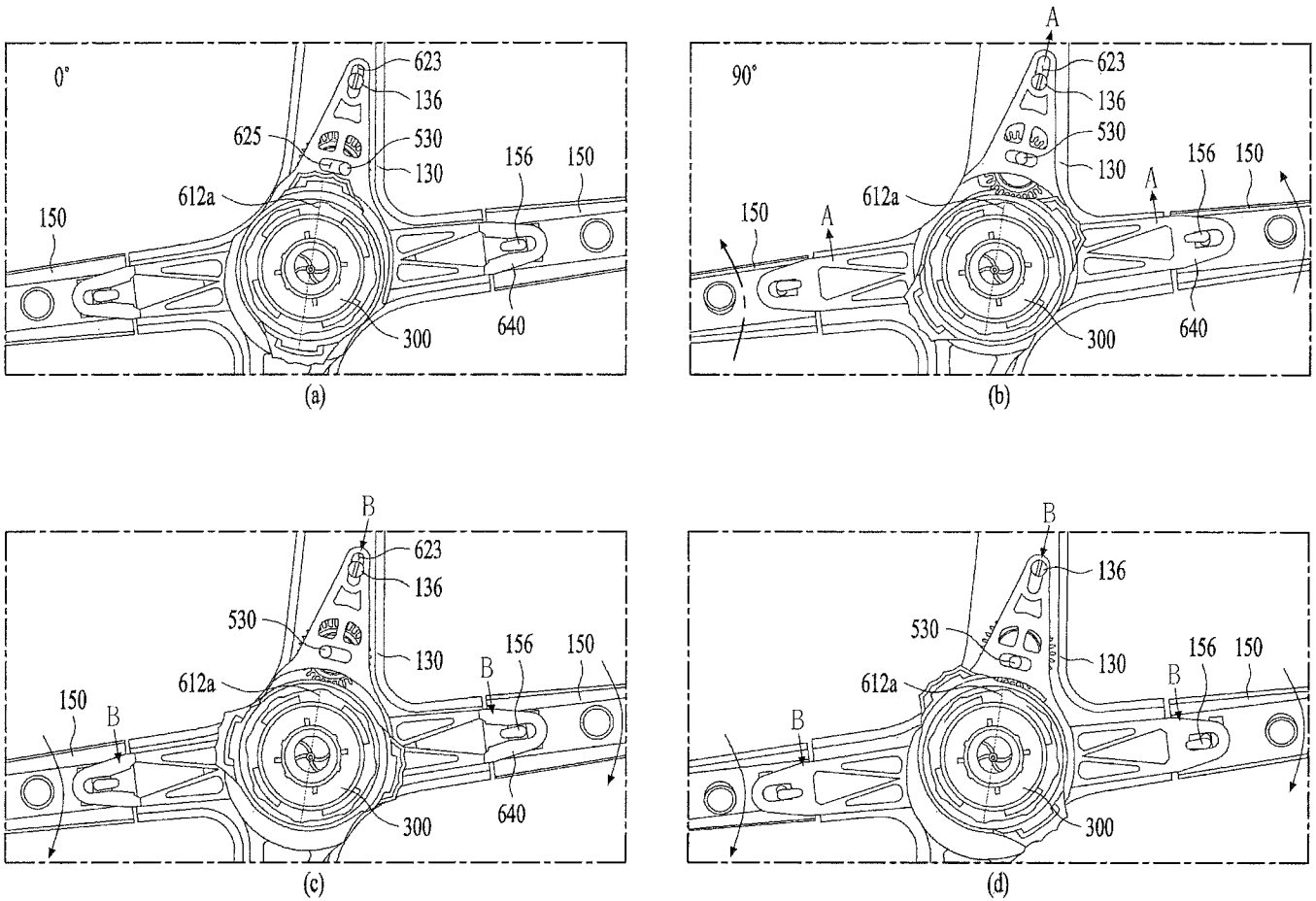
【figure 10】

【figure 11】
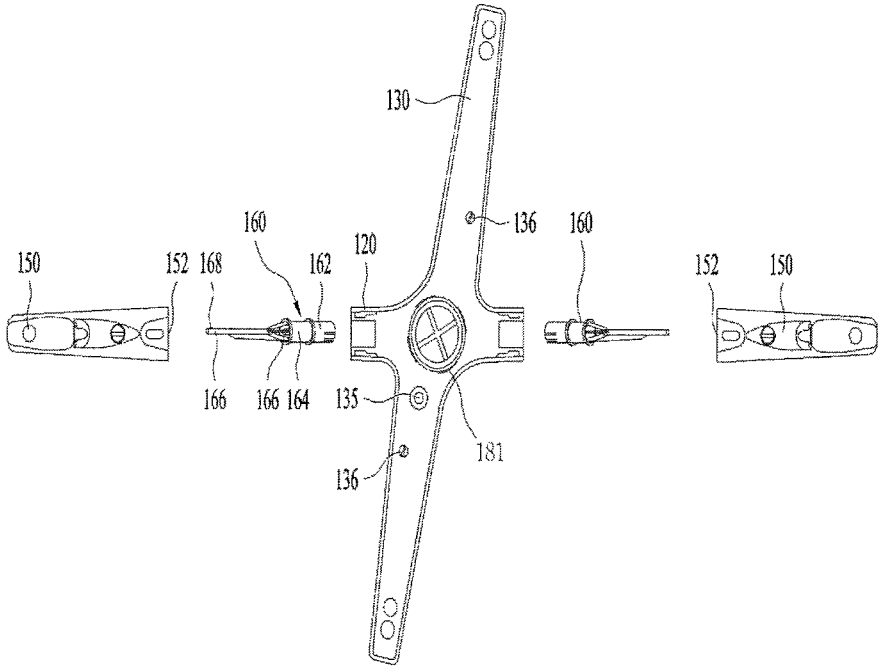

【figure 12】
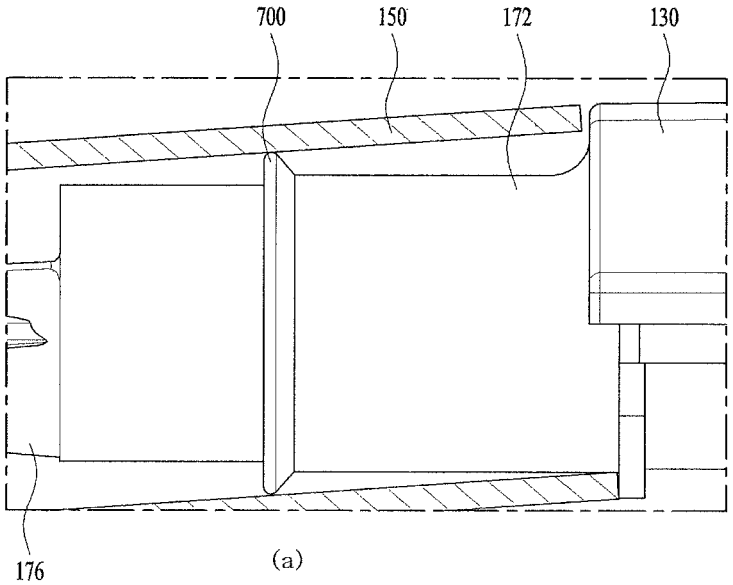
(a)
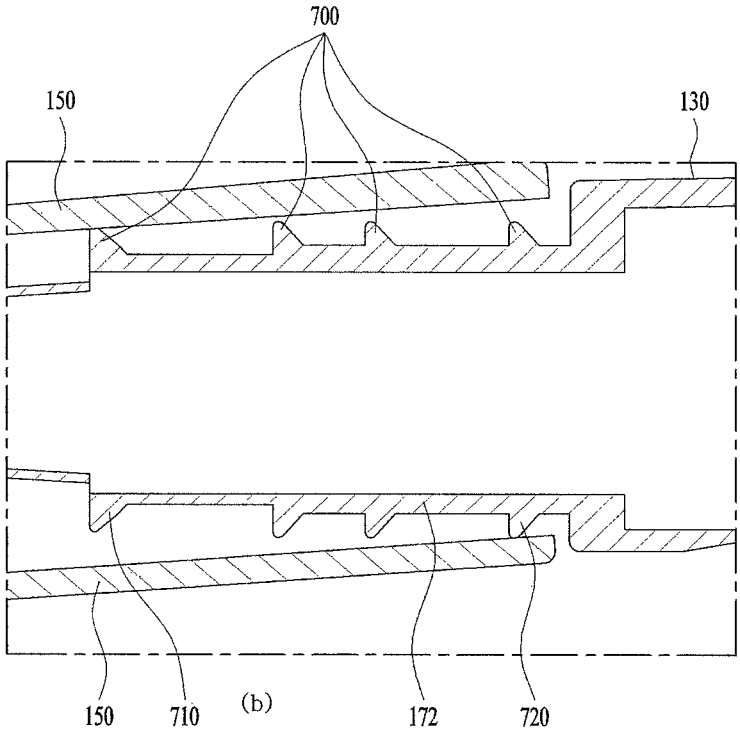
(b)

【figure 13】
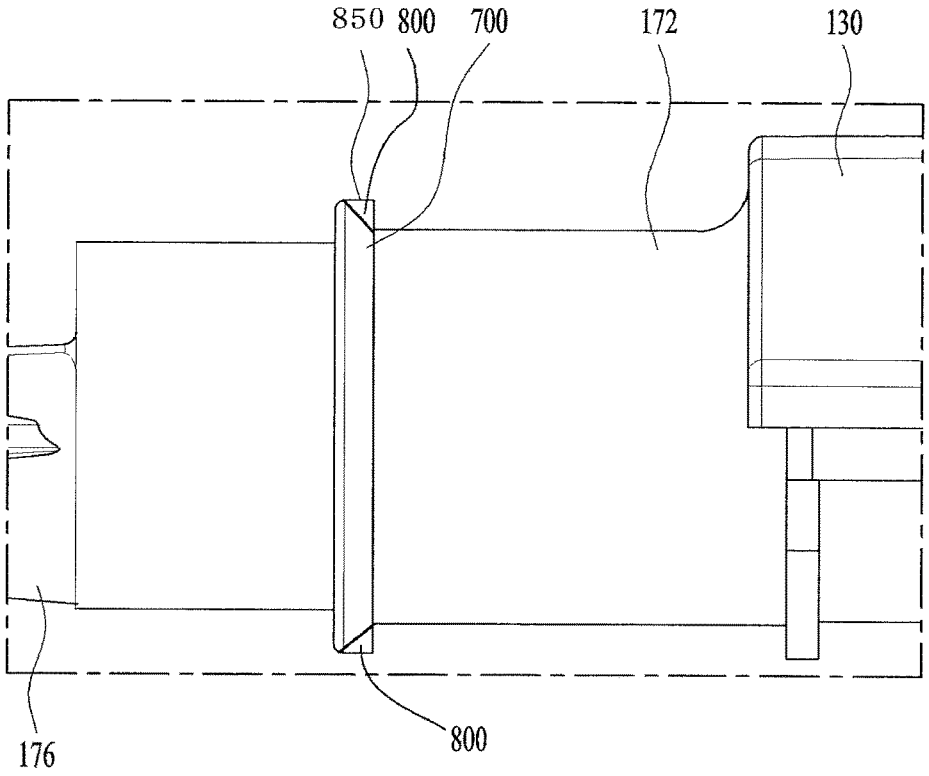

【figure 14】
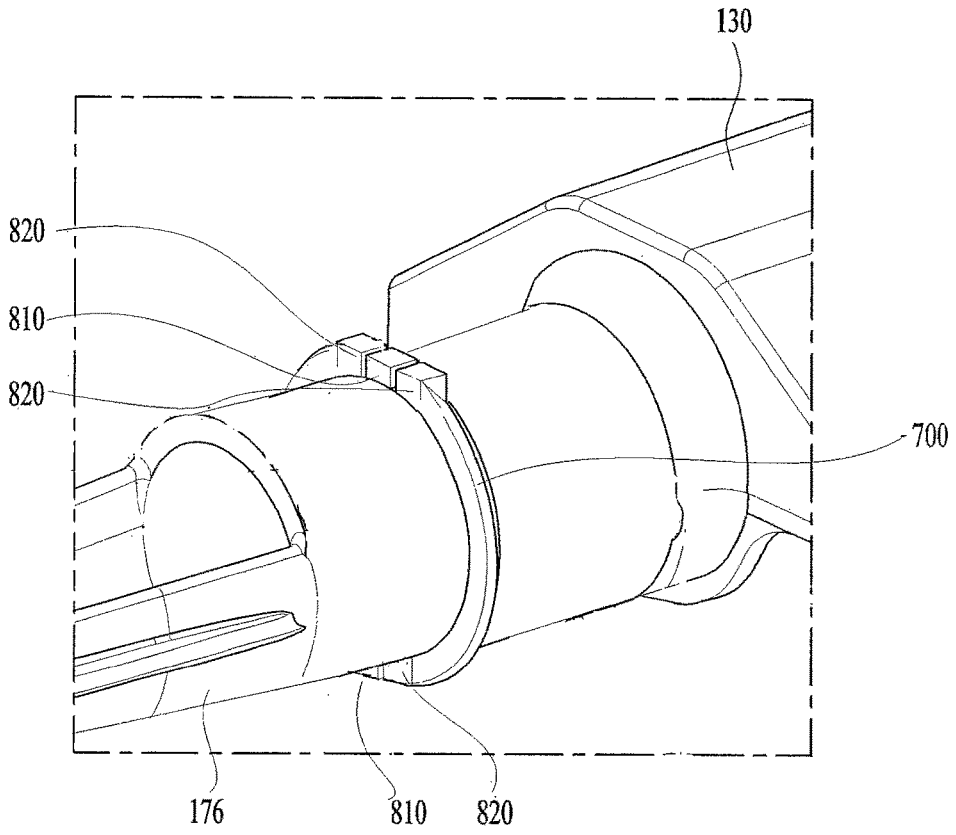

【figure 15】
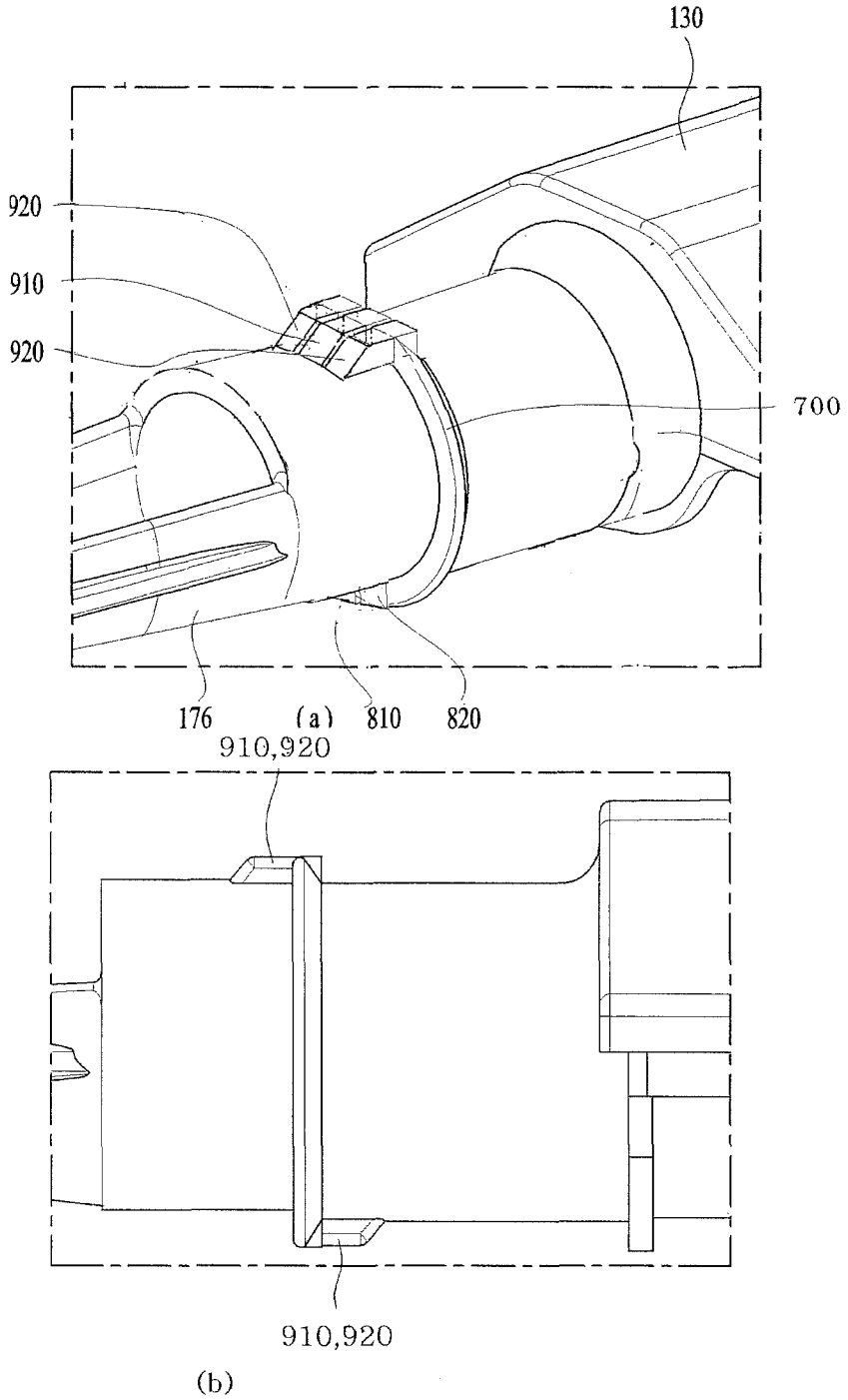

【figure 16】
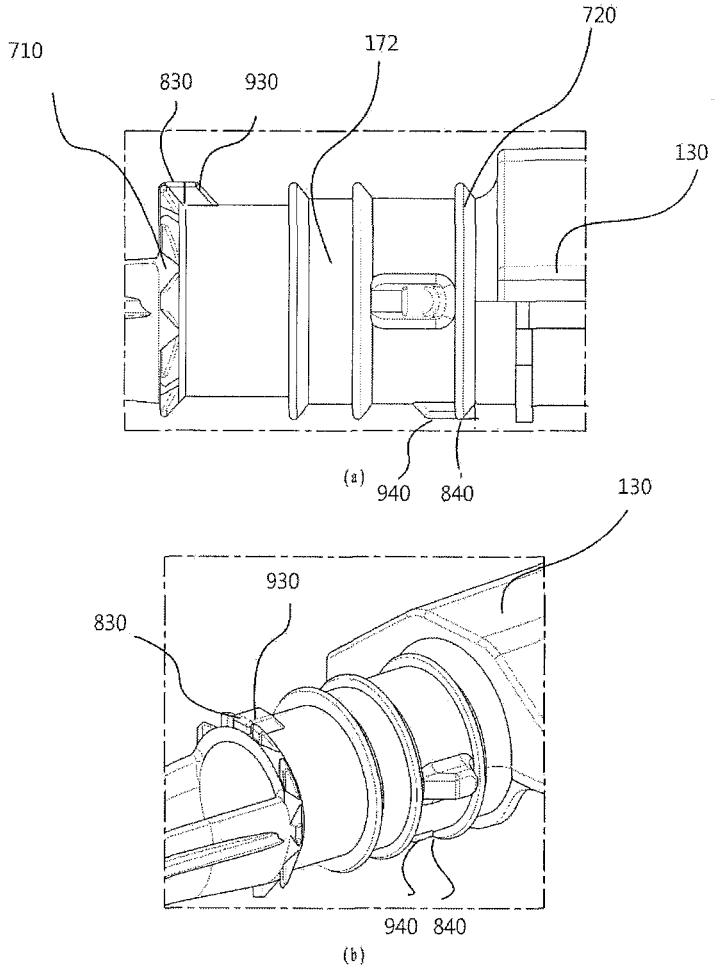

【figure 17】
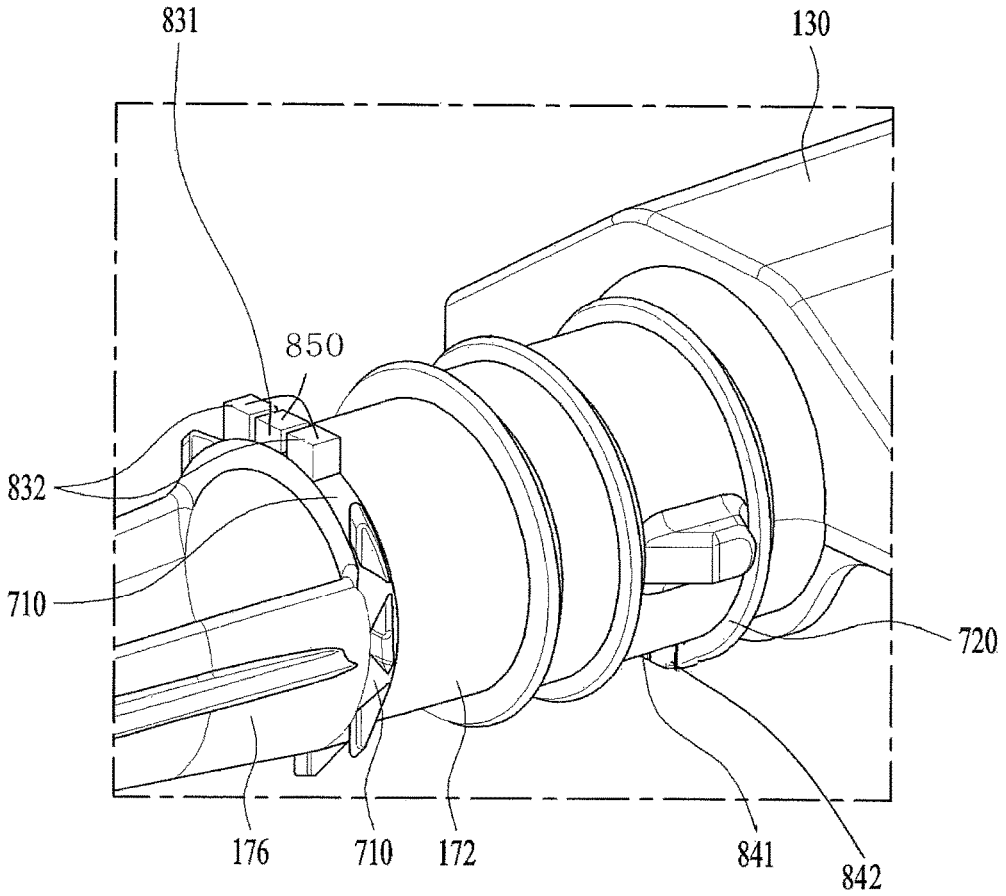

【figure 18】
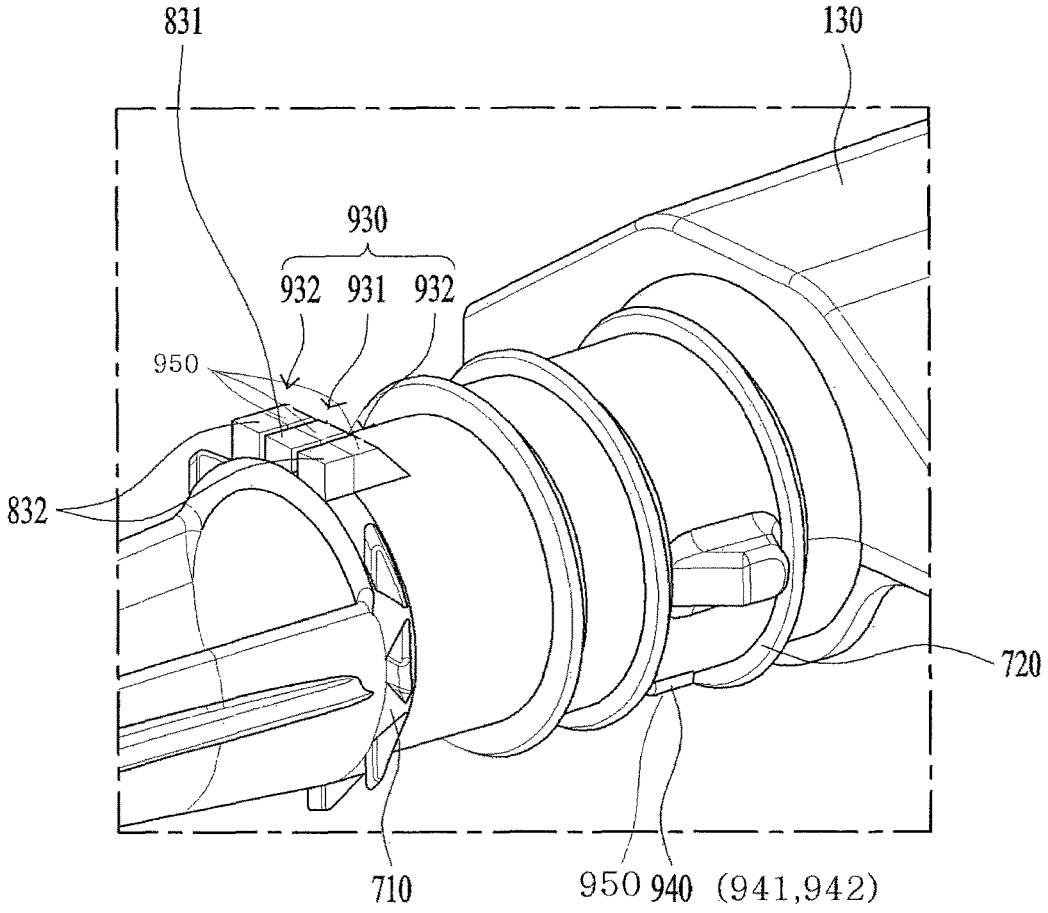

【figure 19】
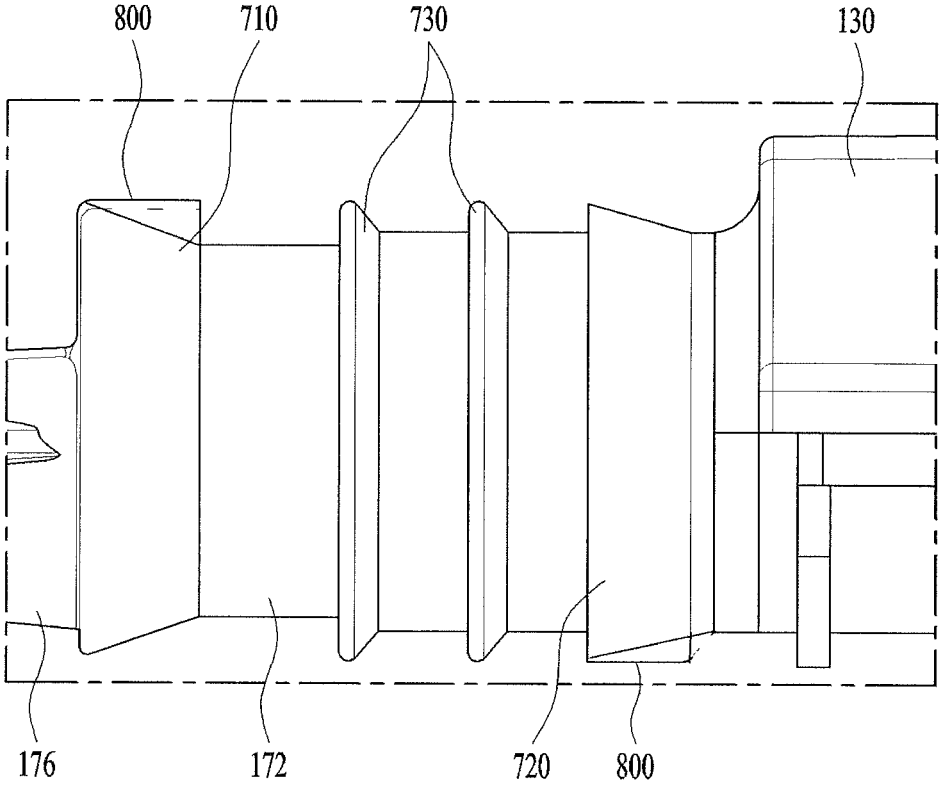

DISHWASHER WITH A MAIN ARM AND AN AUXILIARY ARM

CROSS-REFERENCE TO RELATED APPLICATION

This application claims the benefit of Korean Patent Application No. 10-2016-0000979, filed on Jan. 5, 2016 which is hereby incorporated by reference as if fully set forth herein.

TECHNICAL FIELD

This present application relates to a dishwasher.

BACKGROUND

In general, a dishwasher is an appliance that washes dishes, cookware, etc. (hereinafter referred to as an "object to be washed") by removing foreign substances such as food waste from an object to be washed using a detergent and water, e.g., water for washing the object.

Typically, a dishwasher includes a tub defining a washing compartment, a dish rack provided in the tub, in which an object to be washed is accommodated, a spray arm for spraying wash water to the dish rack, a sump for retaining wash water, and a supply passage, through which the wash water retained in the sump is supplied to the spray arm.

Recently, a dishwasher capable of spraying wash water evenly toward an object to be washed through rotation of the spray arm has been developed. Further, in order to improve washing performance, the spray arm is structured such that a portion thereof performs a reciprocating movement (rolling) along a predetermined circular arc path using the rotating force of the spray arm.

Referring to FIG. 1, a conventional spray arm 110, which is provided in the tub so as to perform rotation and a reciprocating movement, includes a main arm 130, which forms a main body, and an auxiliary arm 150, which is removably mounted to the main arm 130.

The main arm 130 is provided with an auxiliary arm connection unit 170 at a portion thereof. The auxiliary arm 150 is removably inserted into the auxiliary a in connection unit 170 so that the auxiliary arm 150 evenly sprays wash water while performing a reciprocating movement along a predetermined circular arc path.

The auxiliary arm connection unit 170 includes an extension pipe 172, which extends from the main arm 130, a shaft 176, which extends from the extension pipe 172 and is inserted into the auxiliary arm 150, and a sealing member 700, which protrudes from the outer circumferential surface of the extension pipe 172 in order to prevent the wash water, discharged from the extension pipe 172, from flowing backward to the outer circumferential surface of the extension pipe 172.

Since the sealing member 700 protrudes from the outer circumferential surface of the extension pipe 172, a load generated by the auxiliary arm 150 is concentrated on the sealing member 700. In addition, a load generated by the supply of wash water is also concentrated on the sealing member 700, and frictional force that is generated when the auxiliary arm 150 rotates is exerted on the sealing member 700.

Therefore, the sealing member 700 is worn down. Specifically, the upper portion and the lower portion of the sealing member 700, on which the load is concentrated, are severely worn down.

Such partial abrasion of the sealing member 700 may cause deterioration in a function of preventing backflow of the wash water and may cause tilting of the auxiliary arm 150.

Therefore, a conventional dishwasher has a problem in that wash water flows backward through the worn portion of the sealing member 700, the pressure and the quantity of wash water supplied to the auxiliary arm 150 are decreased, and consequently the washing force is decreased. In addition, since the auxiliary arm 150 is not maintained at a normal position, washing efficiency is deteriorated.

SUMMARY

Accordingly, the present invention is directed to a dishwasher that substantially obviates one or more problems due to limitations and disadvantages of the related art.

An object of the present invention devised to solve the problem lies in a dishwasher, which is capable of increasing the durability of a sealing member and preventing abrasion, thereby improving washing efficiency.

Another object of the present invention devised to solve the problem lies in a dishwasher, which is capable of increasing the force with which a sealing member supports an auxiliary arm so that the auxiliary arm rotates at a normal position, thereby improving washing efficiency.

A further object of the present invention devised to solve the problem lies in a dishwasher, which is capable of reinforcing the portion of a sealing member on which a load is concentrated and preventing abrasion, thereby enabling the sealing member to consistently function to prevent the backflow of wash water and to support a spray arm.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve the objects and other advantages and in accordance with the purpose of the invention, as embodied and broadly described herein, a dishwasher includes a tub for accommodating an object to be washed, a main arm rotatably provided in the tub in order to spray wash water to the object to be washed, an auxiliary arm rotatably coupled to the main arm in order to spray the wash water to the object to be washed, a fixed gear part secured in the tub in order to rotatably support the main arm and having teeth formed along an outer circumferential surface thereof, a rotating gear unit rotatably mounted to the main arm and configured to be rotated in engagement with the teeth of the fixed gear unit by rotation of the main arm, a link unit connected to the rotating gear unit, the main arm and the auxiliary arm and configured to be reciprocally moved in a diameter direction of the fixed gear unit by rotation of the rotating gear unit so as to allow the auxiliary arm to perform a reciprocating rolling movement to a predetermined angle along a predetermined circular arc path, and an auxiliary arm connection unit connected to the main arm in order to support the auxiliary arm so that the auxiliary arm performs a reciprocating rolling movement to a predetermined angle along the circular arc path. The auxiliary arm connection unit includes an extension pipe provided at the main arm in order to guide wash water supplied to the main arm to the auxiliary arm, a shaft extending from the extension pipe in order to support an interior of the auxiliary arm, and a sealing member protruding from an outer circumferential surface of the extension pipe in order to prevent wash water, introduced into the auxiliary arm, from flowing backward to the extension pipe, and the sealing member includes a support member provided on at least one of an outer circumferential surface of an upper portion of the sealing member and an outer circumferential surface of a lower portion of the sealing member in order to support the interior of the auxiliary arm.

The sealing member may be disposed between a proximal end of the extension pipe and a distal end of the extension pipe, and the support member may be provided at both the upper portion and the lower portion of the sealing member.

The support member may have an exposed surface extending parallel to a horizontal plane.

The support member may include at least one of a first support member disposed at a position corresponding to a vertical radius of the extension pipe and a plurality of second support members arranged symmetrically about the vertical radius of the extension pipe.

The second support members may have exposed surfaces formed to lie in the same plane.

The dishwasher may further include a first support rib extending from the first support member in a longitudinal direction of the extension pipe, and second support ribs extending from the second support members in the longitudinal direction of the extension pipe.

The first support rib provided at the upper portion of the sealing member may extend from the first support member toward a distal end of the extension pipe, the first support rib provided at the lower portion of the sealing member may extend from the first support member toward the main arm, the second support rib provided at the upper portion of the sealing member may extend from the second support member toward the distal end of the extension pipe, and the second support rib provided at the lower portion of the sealing member may extend from the second support member toward the main arm.

The sealing member may include a first sealing member disposed at a distal end of the extension pipe and a second sealing member disposed at a portion of the extension pipe that is adjacent to the main arm, and the support member may include at least one of an upper support member disposed at an upper portion of the first sealing member and a lower support member disposed at a lower portion of the second sealing member.

The upper support member may further include an upper support rib extending toward the main arm, and the lower support member may further include a lower support rib extending toward the distal end of the extension pipe.

The upper support member may include at least one of an uppermost support member disposed at a position corresponding to a vertical radius of the extension pipe and a plurality of upper symmetric support members arranged symmetrically about the vertical radius of the extension pipe, and the lower support member may include at least one of a lowermost support member disposed at a position corresponding to the vertical radius of the extension pipe and a plurality of lower symmetric support members arranged symmetrically about the vertical radius of the extension pipe.

The upper symmetric support members and the lower symmetric support members may have exposed surfaces extending parallel to a horizontal plane.

The dishwasher may further include an upper support rib extending from at least one of the uppermost support member and the upper symmetric support members toward the main arm, and a lower support rib extending from at least one of the lowermost support member and the lower symmetric support members toward the distal end of the extension pipe.

The dishwasher may further include a plurality of third sealing members disposed between the first sealing member and the second sealing member while being spaced apart from the first sealing member and the second sealing member. The upper support rib may extend a predetermined length, the length being shorter than a distance between the first sealing member and a one of the third sealing members that is located adjacent to the first sealing member, and the lower support rib may extend a predetermined length, the length being shorter than a distance between the second sealing member and a one of the third sealing members that is located adjacent to the second sealing member.

The upper support rib may have an exposed surface having a predetermined length, the length being shorter than a length of a contact surface between the upper support rib and the extension pipe, and the lower support rib may have an exposed surface having a predetermined length, the length being shorter than a length of a contact surface between the lower support rib and the extension pipe.

The upper support rib and the lower support rib may be made of an elastic material.

The sealing member may include a first sealing member disposed at a distal end of the extension pipe, a second sealing member disposed at a portion of the extension pipe that is adjacent to the main arm, and a plurality of third sealing members disposed between the first sealing member and the second sealing member while being spaced apart from the first sealing member and the second sealing member. Each of the first sealing member and the second sealing member may have a thickness greater than a thickness of each of the third sealing members, and the support member may be provided on at least one of an upper portion of the first sealing member and a lower portion of the second sealing member.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 is a view illustrating the construction of a sealing member of a conventional dishwasher;

FIG. 2 is a view illustrating the overall construction of a dishwasher according to the present invention;

FIG. 3 is view illustrating a spray arm assembly in the dishwasher according to the present invention;

FIG. 4 is an exploded perspective view of the spray arm assembly in the dishwasher according to the present invention;

FIG. 5 is a view illustrating the bottom surface of a spray arm;

FIG. 6 is a side view of an arm holder;

FIG. 7 is a perspective view of a fixed gear part;

FIG. 8 is a perspective view of a rotating gear unit;

FIG. 9 is a perspective view of a link unit;

FIG. 10 is a view illustrating the rolling operation of an auxiliary arm performed by the link unit;

FIG. 11 is a perspective view of an auxiliary arm connection unit;

FIG. 12 is a view illustrating the state in which the auxiliary arm coupled to the auxiliary arm connection unit is tilted;

FIG. 13 is a view illustrating a sealing member and a support member according to one embodiment of the present invention;

FIG. 14 is a view illustrating the support member according to one embodiment of the present invention;

FIG. 15 is a view illustrating the constitution in which the support member according to one embodiment of the present invention is provided with a support rib;

FIG. 16 is a view illustrating a support member and a support rib according to another embodiment of the present invention;

FIG. 17 is a view illustrating the constitution in which the support member according to another embodiment of the present invention is provided in a plural number;

FIG. 18 is a view illustrating the constitution in which the support member according to another embodiment of the present invention is provided with a support rib; and FIG. 19 is a view illustrating a third embodiment of the present invention.

DETAILED DESCRIPTION

Reference will now be made in detail to the preferred embodiments of the present invention, examples of which are illustrated in the accompanying drawings. In the meantime, a configuration or a control method of a device described hereinafter is provided only for describing embodiments of the present invention, but not for limiting the scope of patent rights of the present invention. Wherever possible, the same reference numbers will be used throughout the drawings to refer to the same or like parts.

As shown in FIG. 2, a dishwasher 1 according to one embodiment of the present invention may include a tub 2 defining a washing compartment therein, a door 3 for selectively opening and closing the washing compartment, a dish rack 4 provided in the tub 2 so as to accommodate an object to be washed therein, a sump 5 provided in the tub 1 so as to retain wash water therein, and a spray arm assembly 10 provided in the tub 1 so as to spray wash water toward the object to be washed, which is accommodated in the dish rack 4.

The dish rack 4 may be mounted so as to be drawn out forward from the tub 2. Therefore, a user may put an object to be washed in the dish rack 4 after pulling the dish rack 4 out and forward from the tub 2.

As shown in FIG. 3, the dishwasher may include a sump cover 20, which serves as the top surface of the sump 5, and a sump discharge unit 30, which is provided at the sump cover 20. The wash water sprayed into the tub 2 may be collected in the sump 5 through the sump discharge unit 30. Although not illustrated, a water supply pump may be provided in the sump 5 to transfer the wash water retained in the sump 5 to the spray arm assembly 10.

The wash water collected in the sump 5 may be supplied again to the spray arm assembly 10 by the water supply pump provided in the sump 5.

The spray arm assembly 10 may be mounted to the sump cover 20, and may function to spray the wash water retained in the sump 5 to the object to be washed accommodated in the dish rack 4. The spray arm assembly 10 may include a spray arm 100, for spraying wash water, and a fixed gear unit 200 and an arm holder 300, which are mounted to the sump cover 20 so as to rotatably support the spray arm 100.

The wash water may flow into the spray arm assembly 10 via the sump 5, and may be then sprayed toward an object to be washed through the spray arm 100.

Unlike the structure illustrated in FIG. 3, the spray arm assembly 10 may not be disposed below the dish rack 4, but may be disposed above the dish rack 4. In some implementations, the spray arm assembly 10 may be provided in a plural number such that the spray arm assemblies 10 spray wash water toward the regions above and below the dish rack 4.

The spray arm assembly 10 is coupled to the sump cover 20.

Hereinafter, the structure of the spray arm assembly 10 will be explained.

FIG. 4 is an exploded perspective view of the spray arm assembly 10.

Referring to FIG. 4, the spray arm assembly 10 according to an embodiment of the present invention may include a spray arm 100, a fixed gear unit 200, an arm holder 300, a flow passage switching unit 400, a rotating gear unit 500, and a link unit 600.

An arm holder coupling unit 180 may be provided on the bottom surface of the spray arm 100, and the arm holder 300, which is coupled to the arm holder coupling unit 180, may be provided on the sump cover 20 (refer to FIG. 4). The arm holder 300 may be rotatably coupled to the sump cover 20. That is, the arm holder 300 may be rotated together with the spray arm 100, and may also serve as a rotating shaft of the spray arm 100.

The wash water supplied from the sump 5 flows into the arm holder 300 and is then supplied to the spray arm 100.

The flow passage switching unit 400 may be accommodated in the arm holder 300. When the water pressure in the arm holder 30 is increased as the wash water flows into the arm holder 300, the flow passage switching unit 400 may move upwards, and when the inflow of the wash water into the arm holder 300 is stopped, the water pressure in the arm holder 300 may be decreased, and thus the flow passage switching unit 400 may move downwards.

The spray arm 100 may include a main arm 130, on the bottom surface of which the arm holder coupling unit 180, which is coupled with the arm holder 300, is disposed, and an auxiliary arm 150, which is rotatably coupled to the main arm 130.

The main arm 130 and the auxiliary arm 150 may be formed with a plurality of flow passages, through which the wash water supplied from the sump 5 flows.

The main arm 130 may have spray holes 133 and 134 formed in the top surface thereof, through which the wash water introduced into the main arm 130 is sprayed. The wash water introduced into the main arm 130 from the sump 5 may be sprayed upwards from the main arm 130 through the spray holes 133 and 134.

The spray holes in the main arm 130 may include first spray holes 133, which are formed in a portion of the main arm 130 extending in one direction from the rotational center, positioned to correspond to the fixed gear unit 200, so as to spray wash water toward an object to be washed, and second spray holes 134, which are formed in a portion of the main arm 130 extending in the opposite direction from the rotational center, positioned to correspond to the fixed gear unit 200, so as to spray wash water toward an object to be washed.

The auxiliary arm 150 may be coupled to the main arm 130 so as to perform a reciprocating movement (rolling) along a predetermined circular arc path.

In detail, the main arm 130 may have an extension portion 120 formed to extend in a radial direction, and the auxiliary arm 150 may be coupled to the extension portion 120 so as to perform a reciprocating movement along a predetermined circular arc path.

The auxiliary arm 150 may have auxiliary spray holes 153 and 154 formed so as to spray the wash water introduced into the main arm 130.

The auxiliary spray holes in the auxiliary arm 150 may include third spray holes 153, which are formed in a portion of the auxiliary arm 150 extending in one direction from the rotational center, positioned to correspond to the fixed gear unit 200, so as to spray wash water toward an object to be washed, and fourth spray holes 154, which are formed in a portion of the auxiliary arm 150 extending in the opposite direction from the rotational center, positioned to correspond to the fixed gear unit 200, so as to spray wash water toward an object to be washed.

The main arm 130 and the auxiliary arm 150 may extend radially from the rotational center, positioned to correspond to the fixed gear unit 200, and may be angularly spaced apart from each other at a predetermined angle.

The portion of the main arm 130 in which the first spray holes 133 are formed and the portion of the auxiliary arm 150 in which the third spray holes 153 are formed may be angularly spaced apart from each other at an acute angle or a right angle.

The portion of the main arm 130 in which the first spray holes 133 are formed and the portion of the auxiliary arm 150 in which the fourth spray holes 154 are formed may be angularly spaced apart from each other at an obtuse angle or a right angle.

Although not illustrated, the extension portion 120 may have a transfer flow passage formed therein, through which the wash water supplied from the sump 5 flows. The wash water flowing through the transfer flow passage may be introduced into an auxiliary flow passage (not illustrated) formed in the auxiliary arm 150.

Therefore, the wash water introduced into the auxiliary flow passage formed in the auxiliary arm 150 may be sprayed through the auxiliary spray holes 153 and 154.

The spray arm 100 may be rotated by a separate driving device (not illustrated). In some implementations, the spray arm 100 may be rotated by the repulsive force that is generated when wash water is sprayed through the spray holes 133 and 134 or the auxiliary spray holes 153 and 154.

That is, the spray arm 100 may be rotated by the repulsive force that is generated when wash water is sprayed, without the use of a separate driving device such as a motor or the like.

Referring to FIG. 5, the main arm 130 may include a gear-rotating shaft 135, which is inserted into the rotating gear unit 500 and serves as the rotating shaft of the rotating gear unit 500. The gear-rotating shaft 135 may be formed to protrude from a lower frame of the main arm 130. The gear-rotating shaft 135 may be disposed on the bottom surface of the main arm 130, as illustrated in the drawings, but the position of the gear-rotating shaft 135 is not limited to the bottom surface of the main arm 130.

The main arm 130 may have guide protrusions 136 formed so as to guide the movement of the link unit 600.

The auxiliary arm 150 may have force transmission parts 156 formed so as to receive force from the link unit 600. The force transmission parts 156 may be embodied as protrusions, which protrude downwards from the bottom surface of the auxiliary arm 150.

As illustrated in FIG. 6, the arm holder 300 may include an inlet portion 310, through which the wash water retained in the sump 5 is introduced, and a coupling portion 330, which is coupled to the spray arm 100.

The inlet portion 310 may be formed with a hole, through which the wash water retained in the sump 5 is supplied. Therefore, the wash water retained in the sump 5 may flow into the arm holder 300 through the hole formed in the inlet portion 310.

The inlet portion 310 may have a separation-preventing portion 315, formed to prevent the arm holder 300 from being separated from the sump cover 20. The separation-preventing portion 315 may be formed by expanding an end portion of the inlet portion 310. The separation-preventing portion 315 may be connected to the sump cover 20. Accordingly, the inlet portion 310 may be rotatably coupled to the sump cover 20.

The arm holder 300 may be received in the arm holder coupling unit 180, which is provided on the bottom surface of the spray arm 100 (refer to FIG. 5).

Referring to FIG. 7, the fixed gear unit 200 may be coupled to the sump cover 20 in a manner such that fastening portions 223 provided at the fixed gear unit 200 are fastened to the sump cover 20.

Unlike the arm holder 300, the fixed gear unit 200 may be non-rotatably secured to the sump cover 20.

The fixed gear unit 200 according to the embodiment of the present invention may include a rim portion 210, which is provided with a plurality of teeth 213, and support portions 220, which extend downwards from the rim portion 210. The arm holder coupling unit 180 may be inserted into the rim portion 210. The rim portion 210 may have gap-reducing protrusions 215 formed to reduce the gap between the rim portion 210 and the arm holder coupling unit 180. The gap-reducing protrusions 215 may be provided in a plural number, and may protrude toward the center of the rim portion 210.

The support portions 220 may be disposed at two opposing positions on the rim portion 210.

Each of the support portions 220 may be provided with the fastening portion 223, which is fastened to the sump cover 20. Each of the fastening portions 223 may be embodied as a protrusion protruding from the side surface of the corresponding support portion 220. The fixed gear unit 200 may be secured to the sump cover 20 via the fastening of the fastening portions 223 to the sump cover 20.

Each of the support portions 220 may be further provided with a knob portion 225, which a user grabs to couple or remove the fixed gear unit 200 to/from the sump cover 20. The knob portions 225 may be formed to extend in the radial direction of the fixed gear unit 200.

Further, each of the knob portions 225 may be formed such that at least a portion of the surface thereof is convex or concave so that a user can easily grab the knob portions 225.

FIG. 8 is a perspective view of the rotating gear unit.

The rotating gear unit 500 may be rotatably mounted to the bottom surface of the spray arm 100, and may be engaged with the fixed gear unit 200.

Referring to FIG. 8, the rotating gear unit 500 according to the embodiment of the present invention may include a rim portion 510, which is provided with a plurality of teeth 513 formed along the outer circumferential surface thereof, a rotating shaft insertion portion 520, into which the gear-rotating shaft 135 is inserted, and an eccentric protrusion 530, which is inserted into the link unit 600 so as to allow the link unit 600 to perform a reciprocating movement. The eccentric protrusion 530 may be disposed inside the rim portion 510 or may be disposed eccentrically from the center of the rim portion 510. In other words, the eccentric protrusion 530 can be apart from center of the rotating gear unit 500 or the rotational axis S of rotating gear unit 500. The gear-rotating shaft 135 may be inserted into the center of the rotating gear unit 500. The rotating shaft insertion portion 520 can be implemented as an empty space formed in the center of the rotating gear unit 500.

The eccentric protrusion 530 may protrude and extend in the direction of the rotational axis S of the rotating gear unit 500. The rotational axis S corresponds to the rotational center of the rotating gear unit 500.

In some implementations, unlike the structure illustrated in the drawings, the eccentric protrusion 530 may be disposed on the outer circumferential surface of the rim portion 510.

When the spray arm 100 rotates, the rotating gear unit 500 may revolve along the circumference of the fixed gear unit 200, which is secured to the sump cover 20, and may also rotate in engagement with the fixed gear unit 200 at the same time. The rotating gear unit 500 may be coupled to the gear-rotating shaft 135, which is provided at the main arm 130, in an insertion manner. Accordingly, the rotating gear unit 500 may be coupled to the main arm 100, and may be capable of rotating about the gear-rotating shaft 135.

FIG. 9 illustrates a perspective view of the link unit.

The link unit 600 may be connected to the main arm 130 and the auxiliary arm 150 by the guide protrusions 136 and the force transmission parts 156 (refer to FIG. 3). That is, the link unit 600 may be connected to 4 points of the spray arm 100.

The link unit 600 may include a ring-shaped rim portion 610, and a plurality of extension portions 620, 630, 640 and 650, which extend from the rim portion 610 in the radial direction.

The rim portion 610 may be formed with an insertion hole 612, into which the arm holder coupling unit 180 is inserted.

The insertion hole 612 may be formed to have an elliptical shape.

Therefore, the arm holder coupling unit 180 may move in the direction of the axis 612*a* of the insertion hole 612.

The rim portion 610 may be further provided with a reinforcement rib 617 for increasing the rigidity of the rim portion 610. The reinforcement rib 617 may be formed in the circumferential direction of the rim portion 610, and may protrude upwards.

The first extension portions 620 and 630 may be coupled to the main arm 130, and the second extension portions 640 and 650 may be coupled to the auxiliary arm 150.

In detail, the first extension portions 620 and 630 may be provided with guide portions 623 and 633, into which the guide protrusions 136 of the main arm 130 are fitted, and the second extension portions 640 and 650 may be provided with transmission portions 643 and 653, into which the force transmission parts 156 of the auxiliary arm 150 are fitted.

Therefore, the movement of the link unit 600 may be transmitted to the auxiliary arm 150 through the force transmission parts 146 and 156.

Any one of the extension portions 620, 630, 640 and 650 may be further provided with a recessed portion 624 in order to avoid interference with the rotating gear unit 500. The recessed portion 624 may be provided with an insertion portion 625, into which the eccentric protrusion 530 of the rotating gear unit 500 is inserted. The insertion portion 625, as illustrated in the drawings, may be formed in an elongated hole shape.

As the link unit 600 transmits the force supplied from the rotating gear unit 500 to the force transmission parts 146 and 156, the auxiliary arm 150 may perform a reciprocating movement (rolling) along a predetermined circular arc path. That is, the reciprocating movement of the link unit 600 may be converted into the reciprocating movement (rolling) of the auxiliary arm 150 along the circular arc path.

Referring to FIG. 10, the constitution in which the link unit 600 rotates the auxiliary arm 150 depending on the rotation of the rotating gear unit 500 will be explained.

In particular, FIGS. 10*a*, 10*b*, 10*c* and 10*d* are views showing the bottom surface of the spray arm assembly 10 when the rotating gear unit 500 rotates 0 degrees, 90 degrees, 180 degrees and 270 degrees, respectively.

Referring to FIG. 10*a*, when the rotating gear unit 500 is in an initial state, e.g., a non-rotated state, the eccentric protrusion 530 is located at one end portion of the insertion portion 625. Referring to FIG. 10*b*, when the rotating gear unit 500 rotates 90 degrees counterclockwise, the link unit 600 is moved in the direction A of the axis 612*a* of the insertion hole 612 by the eccentric protrusion 530.

That is, since the rim portion 610 is formed in an elliptical shape, the rim portion 610 moves linearly toward the main arm 130 as the rotating gear unit 500 revolves around the fixed gear unit 200. At this time, since the main arm 130 and the auxiliary arm 150 are angularly spaced apart from each other at a right angle or an acute angle, as the link unit 600 moves in the direction of the axis 612*a*, the extension portion 640 applies force to the force transmission unit 156 in the moving direction of the link unit 600.

Accordingly, the auxiliary arm 150 moves upwards (in the drawing) along a predetermined circular arc path at a predetermined angle. The angle at which the auxiliary arm 150 reciprocates may be about 40 degrees.

Referring to FIG. 10*c*, when the rotating gear unit 500 rotates 90 degrees further counterclockwise, the link unit 600 moves in the direction B of the axis 612*a*, which is opposite the direction A.

Accordingly, the link unit 600 returns to the position illustrated in FIG. 10*a*. At the same time, the auxiliary arm 150 moves along the circular arc path in the reverse direction by the extension portion 640 and returns to its original position.

Referring to FIG. 10*d*, when the rotating gear unit 500 rotates 90 degrees further counterclockwise, the link unit 600 is moved in the direction B of the axis 612*a* by the eccentric protrusion 530.

Since the rim portion 610 is formed in an elliptical shape, the rim portion 610 moves linearly in the reverse direction as the rotating gear unit 500 revolves around the fixed gear unit 200.

At this time, the auxiliary arm 150 moves along the circular arc path at a predetermined angle.

The angle at which the auxiliary arm 150 reciprocates may be about 40 degrees.

In other words, as the rim portion 610 of the link unit 600 reciprocates linearly toward the first spray holes 133 and the second spray holes 134 of the main arm 130, the force transmission unit 156 reciprocates linearly through the extension portion 640, thereby allowing the auxiliary arm 150 to perform a reciprocating movement along the circular arc path.

The reciprocating movement of the auxiliary arm 150 along the circular arc path may be considered as vibration movement, and may particularly be considered to correspond to rolling, among several types of vibration including rolling, yawing and pitching.

FIG. 11 is a view illustrating an auxiliary arm connection unit.

Referring to FIG. 11, an auxiliary arm connection unit 160 of the present invention may include a communication pipe 162, which is inserted into the main arm 130, a flow pipe 164, which communicates with the communication pipe 162 and through which wash water discharged from the communication pipe 162 flows, a shaft 166, which is connected to the flow pipe 164, and a projection 168, which protrudes from the shaft 166.

The shaft 166 is inserted into an auxiliary flow passage 152, which is formed in the auxiliary arm 150. The wash water discharged from the extension portion 120 flows through the auxiliary flow passage 152, and the wash water flowing through the auxiliary flow passage 152 is sprayed outside through the auxiliary spray holes 153 and 154.

The projection 168, as illustrated in the drawings, may be formed in a column shape.

The auxiliary flow passage 152 may have a connection portion, which is formed around the inner circumferential surface of the auxiliary flow passage 152 and which is connected with the main arm 130 through contact with the flow pipe 164.

The connection portion of the auxiliary flow passage 152 may function to support the weight of the flow pipe 164 through contact with the flow pipe 164.

In the above-described structure, the wash water discharged from the main arm 130 may be supplied to the auxiliary arm 150 through the auxiliary arm connection unit 160.

However, there may be a problem in that a gap may be formed in the connection portion between the main arm 130 and the auxiliary arm 150 in the event of a manufacturing error of the auxiliary arm connection unit 160. That is, a large amount of wash water may leak through the gap when it is discharged from the main arm 130.

In particular, wash water primarily leaks through the coupling portion between the communication pipe 162 and the main arm 130, and flows backward and secondarily leaks through the connection portion of the auxiliary flow passage 152, which connects the main arm 130 and the auxiliary arm 150.

Because wash water is not smoothly supplied to the auxiliary arm 150 due to the above-described water leakage, washing efficiency is deteriorated. This water leakage becomes more severe when the pressure of the wash water is relatively high.

In order to solve the water leakage problem, as illustrated in FIG. 1, an auxiliary arm connection unit 170 according to another embodiment of the present invention is formed integrally with the main arm 130.

The auxiliary arm connection unit 170 may include an extension pipe 172, which is formed integrally with the main arm 130 and extends therefrom, and a shaft 176, which extends from the extension pipe 172 and is inserted into the auxiliary flow passage 152 of the auxiliary arm 150.

The auxiliary arm connection unit 170 according to the embodiment of the present invention has the same constitution as the aforementioned auxiliary arm connection member 160, except for the integral formation of the extension pipe 172 with the main arm 130.

In other words, the communication pipe 162 and the flow pipe 164 in the aforementioned auxiliary arm connection member 160 may be replaced by the extension pipe 172, which is formed integrally with the main arm 130, in the auxiliary arm connection unit 170 according to this embodiment.

Therefore, it is possible to prevent wash water from leaking between the main arm 130 and the extension pipe 172.

Further, since the main arm 130 and the auxiliary arm connection unit 170 are formed integrally with each other, it becomes possible to produce these components using an injection molding method or the like. Accordingly, an additional assembly process may be obviated, which leads to an improvement in manufacturing efficiency.

Hereinafter, the embodiment of the present invention will be explained with reference to the structure in which the extension pipe 172 is formed integrally with the main arm 130. However, the present invention is not limited to this embodiment, and the extension pipe may be removably mounted to the main arm 130.

The structure capable of preventing wash water from leaking through the connection portion of the auxiliary flow passage 152 connecting the main arm 130 and the auxiliary arm 150 will now be explained with reference to FIG. 1.

A sealing member 700 may be provided in the connection portion of the auxiliary flow passage 152 connecting the main arm 130 and the auxiliary arm 150, in order to prevent wash water from flowing backward.

The sealing member 700 is formed to have a ring shape, which protrudes from the outer circumferential surface of the extension pipe 172 (refer to FIG. 1).

The sealing member 700 may be disposed between a proximal end of the extension pipe 172, which extends from the main arm 130, and a distal end of the extension pipe 172, to which the shaft 176 is connected.

The sealing member 700 may include a first sealing member 710, which is disposed at the proximal end of the extension pipe 172, a second sealing member 720, which is disposed at the distal end of the extension pipe 172, and at least one third sealing member 730, which is disposed between the first sealing member and the second sealing member (refer to FIG. 1).

When the auxiliary arm 150 is inserted into the auxiliary arm connection unit 170, at least one sealing member 700, which is provided around the outer circumferential surface of the extension pipe 172, may be brought into contact with the inner circumferential surface of the auxiliary flow passage 152 of the auxiliary arm 150. Therefore, the sealing member 700 may function to seal the connection portion of the auxiliary flow passage 152 connecting the main arm 130 and the auxiliary arm 150.

The sealing member 700 may prevent the wash water discharged from the extension pipe 172 from flowing backward to the outer circumferential surface of the extension pipe 172.

Therefore, the sealing member 700 may improve the washing efficiency by maintaining the pressure and the quantity of the wash water that flows into the auxiliary arm 150.

The auxiliary arm connection unit 170 may function to transfer wash water to the auxiliary arm 150, and may also function to support the weight of the auxiliary arm 150.

The auxiliary arm 150, which is connected with the auxiliary arm connection unit 170, may be tilted downwards due to its own weight.

When wash water flows into the auxiliary arm 150, the angle at which the auxiliary arm 150 is tilted downwards due to its own weight may increase.

Further, since the auxiliary arm 150 performs a reciprocating movement along the circular arc path, a large frictional force may be exerted on the surface of the auxiliary arm 150 that is in contact with the auxiliary arm connection unit 170.

Referring to FIG. 12*a*, in the case in which a single sealing member 700 is provided around the extension pipe 172.

The sealing member 700 may be divided into the upper portion and the lower portion about the horizontal radius of the extension pipe 172 in the cross section of the extension pipe 172.

As illustrated in FIG. 12*b*, in some implementations, the sealing member 700 may include multiple sealing members 710, 720. The details of the multiple sealing members 710, 720 will be described below.

The structure capable of preventing abrasion of the sealing member 700 will now be explained with reference to FIG. 13.

A single sealing member 700 is provided around the outer circumferential surface of the extension pipe 172. The sealing member 700 may be disposed between the proximal end of the extension pipe 172, at which the extension pipe 172 extends from the main arm 130, and the distal end of the extension pipe 172, at which the shaft 176 extends from the extension pipe 172.

The sealing member 700 may include a support member 800 provided at the outer circumferential surface of the upper portion and the outer circumferential surface of the lower portion of the sealing member 700, which are divided from each other about the horizontal radius of the extension pipe 172, in order to support the interior of the auxiliary arm 150.

The support member 800 may include an exposed surface 850, which is oriented outwards and is a flat surface. The exposed surface 850 may be formed to be parallel to the horizontal plane or the bottom surface of the tub. However, the exposed surface 850 may be formed to have a shape corresponding to the shape of the inner flow passage of the auxiliary arm 150.

The flat exposed surface 850 of the support member 800 may function to evenly disperse the load generated by the auxiliary arm 150.

At least one of the upper portion and the lower portion of the sealing member 700 may be provided with the sealing member 800.

In the case in which the support member 800 is provided at each of the upper portion and the lower portion of the sealing member 700, the support member 800 is capable of more effectively supporting the auxiliary arm 150.

FIG. 14 illustrates the constitution in which the support member 800 is provided at each of the upper portion and the lower portion of the sealing member 700.

The support member 800 may include at least one first support member 810, which is disposed at the uppermost portion of the sealing member 700 or the lowermost portion of the sealing member 700, which corresponds to the vertical radius of the extension pipe 172.

In some implementations, the support member 800 may include a plurality of second support members 820, which are disposed at the upper portion or the lower portion of the sealing member 700 while being arranged symmetrically about the vertical radius of the extension pipe 172. The exposed surfaces 850 of the second support members 820 may lie in the same plane. That is, the plurality of second support members 820 may extend different heights from the sealing member 700, so that the exposed surfaces thereof lie in the same plane.

Accordingly, the second support members 820 may function to evenly disperse the load generated by the auxiliary arm 150.

In some implementations, the support member 800 may include both the first support member 810, which is disposed at the uppermost portion of the sealing member 700 or the lowermost portion of the sealing member 700, which corresponds to the vertical radius of the extension pipe 172, and the second support members 820, which are disposed at the upper portion or the lower portion of the sealing member 700 while being arranged symmetrically about the vertical radius of the extension pipe 172.

The exposed surface 850 of the first support member 810 and the exposed surfaces 850 of the second support members 820, which are provided at the upper portion of the sealing member 700, may lie in the same plane.

That is, the first support member 810 and the second support members 820 may extend different heights from the sealing member 700 so that the exposed surfaces thereof lie in the same plane.

Of course, the exposed surface 850 of the first support member 810 and the exposed surfaces 850 of the second support members 820, which are provided at the lower portion of the sealing member 700, may lie in the same plane.

As a result, the exposed surface 850 of the first support member 810 and the exposed surfaces 850 of the second support members 820, which lie in the same plane, may more evenly disperse the load generated by the auxiliary arm 150.

Referring to FIG. 15, the auxiliary arm connection unit 170 may further include a first support rib 910, which extends from the first support member 810 in the longitudinal direction of the extension pipe 172, and second support ribs 920, which extend from the second support members 820 in the longitudinal direction of the extension pipe 172.

The first support rib 910 and the second support ribs 920 may be formed integrally with the extension pipe 172, or may be separately produced and bonded to the extension pipe 172.

Accordingly, a mold for producing the extension pipe 172 may be simplified, thereby facilitating the manufacturing process and reducing manufacturing costs.

The first support rib 910 and the second support ribs 920 may be made of an elastic material.

Accordingly, even when the auxiliary arm 150 is suddenly tilted or vibrates, the auxiliary arm 150 may effectively return to its original position, or may be stably supported.

The first support rib 910 and the second support ribs 920 may function to evenly disperse the load and to prevent abrasion of the sealing member 700 when the auxiliary arm 150 is tilted.

The first support rib 910 may extend from the first support member 810 toward the distal end of the extension pipe 172, i.e. toward the end of the extension pipe 172 at which the shaft 176 is provided.

The second support ribs 920 may extend from the second support members 820 toward the proximal end of the extension pipe 172, i.e. toward the end of the extension pipe 172 at which the main arm 130 is provided.

That is, the direction in which the first support rib 910 extends and the direction in which the second support ribs 920 extend may be opposite or symmetric to each other about the sealing member 700.

When the auxiliary arm 150 is tilted downwards, the first support rib 910 and the second support ribs 920, which extend in the above-described directions, may support the tilted auxiliary arm 150. The first support rib 910 and the second support ribs 920 may also prevent the auxiliary arm 150 from being tilted.

As a result, it is possible to prevent abrasion of the sealing member 700.

Hereinafter, the constitution in which the sealing member 700 is provided in a plural number will be explained. As illustrated in FIG. 12*b*, the sealing member 700 may be provided in a plural number.

The sealing member 700 may include a first sealing member 710, which is provided at the end of the extension pipe, and a second sealing member 720, which is provided at a position adjacent to the main arm 130. In this case, the weight of the auxiliary arm 150 and the weight of the wash water may be concentrated on the top surface of the first sealing member 710 and the bottom surface of the second sealing member 720. Thus, the top surface of the first sealing member 710 and the bottom surface of the second sealing member 720 may be worn down.

Further, when the auxiliary arm 150 is tilted and performs a rolling motion, the degree of concentration of weight and the intensity of frictional force exerted on the top surface of the first sealing member 710 and the bottom surface of the second sealing member 720 may become higher.

Accordingly, the abrasion of the first sealing member 710 and the second sealing member 720 may become more severe.

Therefore, in order to prevent abrasion of the sealing member 700, there is a need to prevent the auxiliary arm 150 from being tilted or to evenly disperse the load generated by the auxiliary arm 150.

Referring to FIG. 16, the sealing member 700 may include a first sealing member 710, which is provided at the distal end of the extension pipe 172, and a second sealing member 720, which is proved at the proximal end of the extension pipe 172. That is, the first sealing member 710 may protrude from the outer circumferential surface of the extension pipe 172 in the vicinity of the end of the extension pipe 172 from which the shaft 176 extends. The second sealing member 720 may protrude from the outer circumferential surface of the extension pipe 172 in the vicinity of the end of the extension pipe 172 that extends from the main arm 130.

The first sealing member 710 may include an upper support member 830, which is provided at the upper portion of the first sealing member 710.

The second sealing member 720 may include a lower support member 840, which is provided at the lower portion of the second sealing member 720.

Only one of the first sealing member 710 and the second sealing member 720 may be provided with the support member. However, in order to more evenly disperse the load generated by the auxiliary arm 150, it is preferable for the first sealing member 710 and the second sealing member 720 to include the upper support member 830 and the lower support member 840, respectively.

As described above, this is because the weight of the auxiliary arm 150 is concentrated on the upper portion of the first sealing member 710 and the lower portion of the second sealing member 720 when the auxiliary arm 150 is tilted downwards.

Like the first support member 810 and the second support member 820 described above, the upper support member 830 and the lower support member 840 may include exposed surfaces, which are parallel to the horizontal plane.

Accordingly, when the auxiliary arm 150 is tilted, the upper support member 830 and the lower support member 840 evenly support the load generated by the auxiliary arm 150, thereby preventing abrasion of the first sealing member 710 and the second sealing member 720.

The auxiliary arm connection unit 170 may further include an upper support rib 930, which extends from the upper support member 830 in the longitudinal direction of the extension pipe 172, and a lower support rib 940, which extends from the lower support member 840 in the longitudinal direction of the extension pipe 172.

As shown in FIG. 16*b*, the upper support rib 930 may extend from the upper support member 830 toward the main arm 130, and the lower support rib 940 may extend from the lower support member 840 toward the shaft 176.

Accordingly, the upper support rib 930 and the lower support rib 940 may function to evenly disperse the load generated by the auxiliary arm 150 and to support the auxiliary arm 150 when the auxiliary arm 150 is tilted. The upper support rib 930 and the lower support rib 940 may also prevent the auxiliary arm 150 from being tilted.

Further, the upper support member 830, the upper support rib 930, the lower support member 840 and the lower support rib 940 may prevent abrasion of the first sealing member 710 and the second sealing member 720.

As a result, the upper support rib 930 and the lower support rib 940 may evenly support the load generated by the auxiliary arm 150 and may prevent the auxiliary arm 150 from being tilted. In addition, even when the auxiliary arm 150 is tilted, the upper support rib 930 and the lower support rib 940 may evenly support the load, thereby preventing abrasion of the sealing member 700.

The sealing member 700 may further include at least one third sealing member 730, which is disposed between the first sealing member 710 and the second sealing member 720.

Accordingly, the sealing member 700 may more effectively prevent wash water from flowing backward to the outer circumferential surface of the extension pipe 172.

The length of the upper support rib 930, which extends from the first sealing member 710, may be shorter than the distance between the first sealing member 710 and the third sealing member 730, which is located adjacent to the first sealing member 710. The length of the lower support rib 940, which extends from the second sealing member 720, may be shorter than the distance between the second sealing member 720 and the third sealing member 730, which is located adjacent to the second sealing member 720.

The upper support rib 930 and the lower support rib 940 may be formed integrally with the extension pipe 172, or may be separately produced and bonded to the extension pipe 172.

Accordingly, a mold for producing the extension pipe 172 may be simplified, thereby facilitating the manufacturing process and reducing manufacturing costs.

The upper support rib 930 and the lower support rib 940 may be made of an elastic material.

Accordingly, even when the auxiliary arm 150 is suddenly tilted or vibrates, the auxiliary arm 150 may effectively return to its original position or may be stably supported.

In order to maximize these effects, each of the upper support member 830 and the lower support member 840 may be provided in a plural number.

Referring to FIG. 17, the upper support member 830, which is provided at the first sealing member 710, may include at least one of an uppermost support member 831, which is disposed at the uppermost portion of the first sealing member 710 corresponding to the vertical radius of the extension pipe 172, and a plurality of upper symmetric support members 832, which are disposed at the upper portion of the first sealing member 710 while being arranged symmetrically about the vertical radius of the extension pipe 172.

The case in which the upper support member 830 includes the upper symmetric support members 832 is effective in resisting the load generated by the auxiliary arm 150 and abrasion of the first sealing member 710 because the contact area with the auxiliary arm 150 is increased and the auxiliary arm 150 is supported in a balanced manner.

It is more preferable for the upper support member 830 to include both the uppermost support member 831 and the upper symmetric support members 832. This more effectively withstands the load generated by the auxiliary arm 150. However, this is not intended to exclude the constitution in which the upper support member 830 includes only the uppermost support member 831.

In the case in which the upper support member 830 includes only the upper symmetric support members 832 or includes both the uppermost support member 831 and the upper symmetric support members 832, the exposed surfaces 850 of the upper symmetric support members 832 and the exposed surface 850 of the uppermost support member 831 may be aligned with each other.

That is, the exposed surfaces 850 may lie in the same plane.

As a result, the upper support member 830 may more evenly disperse the load generated by the auxiliary arm 150.

Like the upper support member 830, the lower support member 840 may include at least one of a lowermost support member 841, which is disposed at the lowermost portion of the second sealing member 720 corresponding to the vertical radius of the extension pipe 172, and a plurality of lower symmetric support members 842, which are disposed at the lower portion of the second sealing member 720 while being arranged symmetrically about the vertical radius of the extension pipe 172.

This is effective in withstanding the load generated by the auxiliary arm 150 when the lower support member 840 includes the lower symmetric support members 842. In some implementations, the load generated by the auxiliary arm 150 is more effectively withstood when the lower support member 840 includes both the lowermost support member 841 and the lower symmetric support members 842.

As illustrated in FIG. 18, each of the upper support rib 930 and the lower support rib 940 may be provided in a plural number.

The upper support rib 930 may include at least one of an uppermost support rib 931, which extends from the uppermost support member 831, and upper symmetric support ribs 932, which extend from the upper symmetric support members 832.

The lower support rib 940 may include at least one of a lowermost support rib 941, which extends from the lowermost support member 841, and lower symmetric support ribs 942, which extend from the lower symmetric support members 842.

Like the exposed surfaces 850 of the upper support member and the lower support member, the exposed surfaces 950 of the uppermost support rib 931 and the upper symmetric support ribs 932, which extend from the upper support member 830, may be aligned with each other. That is, the exposed surfaces 950 of the upper support rib 930 may lie in the same plane.

The exposed surfaces 950 of the lowermost support rib 941 and the lower symmetric support ribs 942, which extend from the lower support member 840, may be aligned with each other. That is, the exposed surfaces 950 of the lower support rib 940 may lie in the same plane.

The support ribs, which are adequately arranged as described above, may effectively prevent abrasion of the sealing member 700 while reducing manufacturing costs.

FIG. 19 is a view illustrating another example of the sealing member 700.

Referring to FIG. 19, the sealing member 700 may include a first sealing member 710, which is disposed at the distal end of the extension pipe 172, a second sealing member 720, which is disposed at the proximal end of the extension pipe 172, and at least one third sealing member 730, which is disposed between the first sealing member 710 and the second sealing member 720.

The thickness of each of the first sealing member 710 and the second sealing member 720 may be greater than the thickness of the third sealing member 730.

Accordingly, it is possible to effectively prevent abrasion of the first sealing member 710 and the second sealing member 720, to which a relatively large load is applied when the auxiliary arm 150 is tilted.

At least one of the top surface of the first sealing member 710 and the bottom surface of the second sealing member 720 may be provided with a support member 800 having a flat exposed surface.

Accordingly, without the above-described support rib, it is possible to effectively prevent abrasion of the first sealing member 710 and the second sealing member 720, to prevent tilting of the auxiliary arm 150, and to evenly disperse the load even when the auxiliary arm 150 is tilted.

As a result, there is an advantage in that manufacturing costs are reduced and the manufacturing process is simplified.

As is apparent from the above description, the present invention provides a dishwasher characterized in that a support member and a support rib, which have exposed surfaces that are flat and lie in the same plane, are provided at the upper portion or the lower portion of the sealing member 700, thereby preventing the sealing member 700 from being worn down by the load generated by the auxiliary arm 150, enabling the sealing member 700 to consistently prevent backflow of the wash water discharged from the extension pipe 172, and consequently improving the washing effect.

Further, since the auxiliary arm 150 is prevented from being tilted, the auxiliary arm 150 is capable of spraying wash water to a predetermined target area. As a result, the washing efficiency is increased.

In addition, even when the auxiliary arm 150 is tilted and a relatively large load is thus applied to the sealing member 700, abrasion of the sealing member 700 is prevented.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A dishwasher comprising:

a tub configured to accommodate an object;

a main arm that is configured to rotate inside the tub and spray water to the object;

an auxiliary arm that is coupled to the main arm and that is configured to rotate within a first angle and spray water to the object;

a fixed gear unit that is coupled to the tub in order to rotatably support the main arm, the fixed gear unit including a plurality of teeth;

a rotating gear unit that is coupled to the main arm and that is configured to rotate based on rotation of the main arm, the rotating gear unit being in engagement with one or more teeth of the plurality of teeth of the fixed gear unit;

a link unit (i) that is coupled to the rotating gear unit, the main arm, and the auxiliary arm and (ii) that is configured to move in a linear direction based on rotation of the rotating gear unit, wherein the auxiliary arm is configured to rotate within the first angle based on movement of the link unit in the linear direction; and an auxiliary arm connection unit that couples the auxiliary arm to the main arm, wherein the auxiliary arm is rotatable based on the auxiliary arm being coupled to the auxiliary arm connection unit, wherein the auxiliary arm connection unit includes:

an extension pipe that is coupled to the main arm and that is configured to guide water supplied from the main arm to the auxiliary arm, a shaft that extends from the extension pipe and that is configured to support the auxiliary arm, and a sealing member that has a ring shape and that is disposed at an outer peripheral surface of the extension pipe, wherein the sealing member includes:

a support member (i) that is located on a first portion of the sealing member or a second portion of the sealing member and (ii) that is configured to support the auxiliary arm, and wherein the first portion of the sealing member and the second portion of the sealing member are thicker than other portions of the sealing member.

2. The dishwasher of claim 1, wherein the sealing member is located between a first portion of the extension pipe and a second portion of the extension pipe, the first portion of the extension pipe being closer to a central area of the main arm than the second portion of the extension pipe.

3. The dishwasher of claim 2, wherein the support member includes:

a first support member that is located in the first portion of the sealing member, and a second support member that is located in the second portion of the sealing member.

4. The dishwasher of claim 1, wherein a surface of the support member is parallel to a surface of the extension pipe.

5. The dishwasher of claim 1, wherein the support member includes:

a plurality of first support members, at least one of the plurality of first support members is located in a top portion of the extension pipe or a bottom portion of the extension pipe.

6. The dishwasher of claim 5, further comprising:

a plurality of first support ribs, each of the plurality of first support ribs respectively extending from each of the plurality of first support members in a direction parallel to the extension pipe.

7. The dishwasher of claim 6, wherein at least one of the plurality of first support ribs is located in the first portion of the sealing member and extends from the first support member in a direction away from a central area of the main arm, and at least one of the plurality of first support ribs is located in the second portion of the sealing member and extends from the first support member in a direction toward the central area of the main arm.

8. The dishwasher of claim 1, wherein the support member includes:

a plurality of second support members that are symmetrically arranged on the extension pipe about a first axis.

9. The dishwasher of claim 8, wherein two or more surfaces of the plurality of second support members are aligned.

10. The dishwasher of claim 8, further comprising:

a plurality of second support ribs, each of the plurality of second support ribs respectively extending from each of the plurality of second support members in a direction parallel to the extension pipe.

11. The dishwasher of claim 10, wherein at least one of the plurality of second support ribs is located in the first portion of the sealing member and extends from the second support member in a direction away from a central area of the main arm, and at least one of the plurality of second support ribs is located in the second portion of the sealing member and extends from the second support member in a direction toward the central area of the main arm.

12. The dishwasher of claim 1, wherein the sealing member includes:

a first sealing member that is located in a first portion of the extension pipe, and a second sealing member that is located in a second portion of the extension pipe, the first portion of the extension pipe being closer to a central area of the main arm than the second portion of the extension pipe, and wherein the support member includes:

an upper support member that is located in an upper portion of the first sealing member, and a lower support member that is located in a lower portion of the second sealing member.

13. The dishwasher of claim 12, wherein the upper support member further includes an upper support rib that extends in a direction toward the central area of the main arm, and wherein the lower support member further includes a lower support rib that extends in a direction away from the central area of the main arm.

14. The dishwasher of claim 12, wherein the upper support member includes:

a first upper support member that is located in a top portion of the extension pipe, and a plurality of second upper support members that are symmetrically arranged on the extension pipe about a first axis, and wherein the lower support member includes:

a first lower support member that is located in a bottom position of the extension pipe, and a plurality of second lower support members that are symmetrically arranged on the extension pipe about the first axis.

15. The dishwasher of claim 14, wherein a surface of at least one of the plurality of second upper support members is parallel to a surface of at least one of the plurality of second lower support members.

16. The dishwasher of claim 14, further comprising:

an upper support rib that extends from the first upper support member or the plurality of second upper support members in a direction toward the central area of the main arm; and a lower support rib that extends from the first lower support member or the plurality of second lower support members in a direction away from the central area of the main arm.

17. The dishwasher of claim 16, further comprising:

a plurality of third sealing members that are located between the first sealing member and the second sealing member, each of the plurality of third sealing members being isolated from the first sealing member and the second sealing member, wherein the upper support rib extends for a first length, the first length being shorter than a distance between the first sealing member and any of the plurality of third sealing members, and wherein the lower support rib extends a second length, the second length being shorter than a distance between the second sealing member and any of the plurality of third sealing members.

18. The dishwasher of claim 16, wherein a surface of the upper support rib has a first length, the first length being shorter than a length of a surface of the extension pipe to which the upper support rib is coupled, and wherein a surface of the lower support rib has a second length, the second length being shorter than a length of a surface of the extension pipe to which the lower support rib is coupled.

19. The dishwasher of claim 16, wherein the upper support rib and the lower support rib include elastic material.

20. The dishwasher of claim 1, wherein the sealing member includes:

a first sealing member that is located in a first portion of the extension pipe, a second sealing member that is located in a second portion of the extension pipe, and a plurality of third sealing members that are located between the first sealing member and the second sealing member, each of the plurality of third sealing members being isolated from the first sealing member and the second sealing member, wherein the second portion of the extension pipe is closer to a central area of the main arm than the first portion of the extension pipe, wherein the first sealing member and the second sealing member have a respective thickness that is greater than a thickness of each of the plurality of third sealing members, and wherein the support member is located in an upper portion of the first sealing member or a lower portion of the second sealing member.

* * * * *